US010777184B2

(12) United States Patent
Griffin

(10) Patent No.: US 10,777,184 B2
(45) Date of Patent: Sep. 15, 2020

(54) CORRECTION OF A CONTROL SIGNAL IN AN ACTIVE NOISE CONTROL HEADREST

(71) Applicant: The Boeing Company, Chicago, IL (US)

(72) Inventor: Steven Griffin, Kihei, HI (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/145,541

(22) Filed: Sep. 28, 2018

(65) Prior Publication Data

US 2020/0105242 A1 Apr. 2, 2020

(51) Int. Cl.

| | |
|---|---|
| ***H04R 1/08*** | (2006.01) |
| ***G10K 11/178*** | (2006.01) |
| ***H04R 3/00*** | (2006.01) |
| ***H04R 1/02*** | (2006.01) |

(52) U.S. Cl.

CPC .. *G10K 11/17823* (2018.01); *G10K 11/17853* (2018.01); *G10K 11/17881* (2018.01); *H04R 1/025* (2013.01); *H04R 1/08* (2013.01); *H04R 3/002* (2013.01); *G10K 2210/12* (2013.01); *G10K 2210/1281* (2013.01); *G10K 2210/3026* (2013.01); *G10K 2210/3027* (2013.01); *G10K 2210/3221* (2013.01)

(58) Field of Classification Search

CPC ..... G10K 11/17823; G10K 11/17853; G10K 11/17881; G10K 2210/12; G10K 2210/1281; G10K 2210/3026; G10K 2210/3027; G10K 2210/3221; H04R 1/025; H04R 1/08; H04R 3/002; H04R 5/023

USPC ... 381/71, 86, 302, 386, 387, 301, 333, 388, 381/395

See application file for complete search history.

(56) References Cited

U.S. PATENT DOCUMENTS

| | | | | |
|---|---|---|---|---|
| 5,251,263 | A | 10/1993 | Andrea et al. | |
| 5,408,685 | A | 4/1995 | Kennedy et al. | |
| 5,754,662 | A | 5/1998 | Jolly et al. | |
| 5,845,236 | A | 12/1998 | Jolly et al. | |
| 5,852,667 | A | 12/1998 | Pan et al. | |
| 6,305,749 | B1 * | 10/2001 | O'Connor | A47C 7/383 297/397 |
| 2006/0285697 | A1 | 12/2006 | Nishikawa et al. | |
| 2011/0007907 | A1 | 1/2011 | Park et al. | |
| 2012/0097477 | A1 | 4/2012 | Sekine et al. | |
| 2013/0129108 | A1 | 5/2013 | Wurm | |
| 2014/0112490 | A1 * | 4/2014 | Caillet | B60N 2/879 381/71.4 |
| 2016/0039320 | A1 * | 2/2016 | Subat | B29C 45/14311 297/217.5 |

(Continued)

*Primary Examiner* — Vivian C Chin
*Assistant Examiner* — Friedrich Fahnert
(74) *Attorney, Agent, or Firm* — Coats & Bennett, PLLC

(57) ABSTRACT

An active noise control (ANC) headrest comprises a speaker configured to produce antinoise that destructively interferes with frequencies of ambient sound, and a microphone configured to receive feedback comprising a combination of the antinoise and the ambient sound. The headrest further comprises a position sensor configured to detect a position of a flange to which the speaker is mounted relative to a center section of the headrest. The headrest further comprises processing circuitry configured to control the speaker to produce the antinoise based on the feedback and the position detected by the position sensor.

25 Claims, 16 Drawing Sheets

(56) References Cited

U.S. PATENT DOCUMENTS

| | | | | |
|---|---|---|---|---|
| 2016/0100250 | A1* | 4/2016 | Baskin | H04R 1/02 297/217.4 |
| 2016/0284337 | A1 | 9/2016 | Inoue | |
| 2016/0286303 | A1 | 9/2016 | Roberts | |
| 2017/0106775 | A1* | 4/2017 | Takada | B60N 2/80 |
| 2017/0267138 | A1* | 9/2017 | Subat | B60N 2/879 |
| 2018/0056832 | A1* | 3/2018 | Oswald | B60N 2/0244 |
| 2018/0118063 | A1* | 5/2018 | Oswald | B60N 2/879 |
| 2018/0281965 | A1 | 10/2018 | Pons | |
| 2019/0027128 | A1* | 1/2019 | Araki | B64D 11/06 |
| 2019/0118688 | A1* | 4/2019 | Fujikake | B60N 2/879 |
| 2019/0232840 | A1* | 8/2019 | Close | B60N 2/806 |

* cited by examiner

CORRECTION OF A CONTROL SIGNAL IN AN ACTIVE NOISE CONTROL HEADREST

TECHNOLOGICAL FIELD

The present disclosure relates generally to the field of active noise control (ANC). More specifically the present disclosure relates to the field of correcting signaling used in electronics integrated in an ANC headrest.

BACKGROUND

Many environments are inherently noisy. Examples of such environments include roadways, vehicle interiors, manufacturing plants, construction sites, and many other environments that include vehicles and/or heavy machinery. To increase personal comfort in such environments, engineers generally incorporate sound suppressing techniques into their designs. Vehicle interiors, in particular, often include noise suppressing design features which give passengers an increased feeling of luxury and comfort. Accordingly, solutions that are designed to suppress noise are often highly-desired.

SUMMARY

Aspects of the present disclosure are generally directed to active noise control (ANC). Particular aspects are directed to an ANC headrest comprising a center section comprising a longitudinal axis. The headrest further comprises a flange extending away from the center section. The flange is moveable relative to the longitudinal axis of the center section. The headrest further comprises a position sensor configured to detect a position of the flange relative to the center section. The headrest further comprises a speaker mounted to the flange. The speaker is configured to produce antinoise that destructively interferes with frequencies of ambient sound. The headrest further comprises a microphone configured to receive feedback comprising a combination of the antinoise and the ambient sound. The headrest further comprises processing circuitry communicatively coupled to the speaker, the microphone, and the position sensor. The processing circuitry is configured to control the speaker to produce the antinoise based on the feedback and the position detected by the position sensor.

In some aspects, the processing circuitry comprises a servo controller communicatively coupled to the microphone. The servo controller is configured to produce a control signal based on the feedback. In such aspects the processing circuitry further comprises filtering circuitry communicatively coupled to the servo controller, the position sensor, and the speaker. The filtering circuitry is configured to generate a corrected control signal based on the control signal from the servo controller and the position detected by the position sensor. To control the speaker to produce the antinoise, the processing circuitry is configured to use the corrected control signal to control the speaker.

In some such aspects, to generate the corrected control signal based on the control signal from the servo controller and the position detected by the position sensor, the filtering circuitry is configured to set an attenuation level of the antinoise based on the position detected by the position sensor. In some such aspects, to set the attenuation level of the antinoise based on the position detected by the position sensor, the filtering circuitry is configured to set the attenuation level of the antinoise to one of a plurality of predefined attenuation levels selected based on which of a plurality of predefined position ranges comprises the position detected by the position sensor. Additionally or alternatively, in some aspects, to set the attenuation level of the antinoise based on the position detected by the position sensor, the filtering circuitry is configured to decrease or increase the attenuation level of the antinoise responsive to the flange being moved towards or away from the longitudinal axis, respectively.

In some aspects, the headrest further comprises a tuning microphone spaced apart from the microphone. The tuning microphone is configured to receive further feedback comprising a different combination of the ambient sound and the antinoise. In such aspects, the headrest further comprises tuning circuitry communicatively coupled to the tuning microphone and the filtering circuitry. The tuning circuitry is configured to store different values of a configurable filtering parameter in the filtering circuitry over time based on the further feedback from the tuning microphone. To generate the corrected control signal based on the control signal from the servo controller and the position detected by the position sensor, the filtering circuitry is configured to generate the corrected control signal further based on the configurable filtering parameter. In some such aspects, the tuning circuitry is further configured to monitor noise control performance over time based on the further feedback to determine which of the different values of the configurable filtering parameter most reduces a-weighted Root Mean Square (RMS) sound pressure.

In some aspects, relative to the antinoise produced by the corrected control signal, the control signal is configured to produce different antinoise having a greater overall a-weighted RMS sound pressure reduction and a peak amplitude at a higher frequency.

In some aspects, the headrest further comprises a feedforward microphone configured to provide feedforward input to the processing circuitry, wherein the processing circuitry is further configured to enable or disable feedforward control using the feedforward input based respectively on whether the position of the flange detected by the position sensor is away from the longitudinal axis of the center section by more or less than a threshold amount.

Other aspects of the present disclosure are directed to an aircraft. The aircraft comprises a passenger cabin, and a seat disposed within the passenger cabin. The aircraft further comprises a headrest mounted to the seat. The headrest comprises a center section comprising a longitudinal axis. The headrest further comprises a flange extending away from the center section. The flange is moveable relative to the longitudinal axis of the center section. The headrest further comprises a position sensor configured to detect a position of the flange relative to the center section. The headrest further comprises a speaker mounted to the flange. The speaker is configured to produce antinoise that destructively interferes with frequencies of ambient sound. The headrest further comprises a microphone configured to receive feedback comprising a combination of the antinoise and the ambient sound. The headrest further comprises processing circuitry communicatively coupled to the speaker, the microphone, and the position sensor. The processing circuitry is configured to control the speaker to produce the antinoise based on the feedback and the position detected by the position sensor.

In some aspects, the processing circuitry comprises a servo controller communicatively coupled to the microphone. The servo controller is configured to produce a control signal based on the feedback. In such aspects, the processing circuitry further comprises filtering circuitry communicatively coupled to the servo controller, the position sensor, and the speaker. The filtering circuitry is configured to generate a corrected control signal based on the control signal from the servo controller and the position detected by the position sensor. To control the speaker to produce the antinoise, the processing circuitry is configured to use the corrected control signal to control the speaker.

In some such aspects, to generate the corrected control signal based on the control signal from the servo controller and the position detected by the position sensor, the filtering circuitry is configured to set an attenuation level of the antinoise based on the position detected by the position sensor. In some such aspects, to set the attenuation level of the antinoise based on the position detected by the position sensor, the filtering circuitry is configured to set the attenuation level of the antinoise to one of a plurality of predefined attenuation levels selected based on which of a plurality of predefined position ranges comprises the position detected by the position sensor. In some such additional or alternative aspects, to set the attenuation level of the antinoise based on the position detected by the position sensor, the filtering circuitry is configured to decrease or increase the attenuation level of the antinoise responsive to the flange being moved towards or away from the longitudinal axis, respectively.

In some aspects, the aircraft further comprises a tuning microphone spaced apart from the microphone. The tuning microphone is configured to receive further feedback comprising a different combination of the ambient sound and the antinoise. In such aspects, the aircraft further comprises tuning circuitry communicatively coupled to the tuning microphone and the filtering circuitry. The tuning circuitry is configured to store different values of a configurable filtering parameter in the filtering circuitry over time based on the further feedback from the tuning microphone. To generate the corrected control signal based on the control signal from the servo controller and the position detected by the position sensor, the filtering circuitry is configured to generate the corrected control signal further based on the configurable filtering parameter. In some such aspects, the tuning circuitry is further configured to monitor noise control performance over time based on the further feedback to determine which of the different values of the configurable filtering parameter most reduces a-weighted Root Mean Square (RMS) sound pressure.

In some aspects, relative to the antinoise produced by the corrected control signal, the control signal is configured to produce different antinoise having a greater overall a-weighted RMS sound pressure reduction and a peak amplitude at a higher frequency.

In some aspects, the aircraft further comprises a feedforward microphone configured to provide feedforward input to the processing circuitry, wherein the processing circuitry is further configured to enable or disable feedforward control using the feedforward input based respectively on whether the position of the flange detected by the position sensor is away from the longitudinal axis of the center section by more or less than a threshold amount.

Other aspects are directed to a method implemented by an ANC headrest. The method comprises producing antinoise from a speaker of the headrest. The antinoise destructively interferes with frequencies of ambient sound and the speaker is mounted to a flange of the headrest that extends away from a center section of the headrest and is movable relative to a longitudinal axis of the center section. The method further comprises receiving feedback comprising a combination of the antinoise and the ambient sound, and detecting a position of the flange relative to the center section. The method further comprises controlling the speaker to produce the antinoise based on the feedback and the detected position of the flange relative to the center section.

In some aspects, the method further comprises using a servo controller to produce a control signal based on the feedback, and generating a corrected control signal based on the control signal from the servo controller and the detected position of the flange relative to the center section. Controlling the speaker to produce the antinoise comprises using the corrected control signal to control the speaker. In some such aspects, generating the corrected control signal based on the control signal from the servo controller and the detected position of the flange relative to the center section comprises setting an attenuation level of the antinoise to one of a plurality of predefined attenuation levels selected based on which of a plurality of predefined position ranges comprises the detected position. In some additional or alternative aspects, generating the corrected control signal based on the control signal from the servo controller and the detected position of the flange relative to the center section comprises decreasing or increasing an attenuation level of the antinoise responsive to the flange being moved towards or away from the longitudinal axis, respectively.

In some additional or alternative aspects, the method further comprises using a tuning microphone spaced apart from the microphone to receive further feedback comprising a different combination of the ambient sound and the antinoise, and using different values of a configurable filtering parameter to modify the control signal differently over time based on the further feedback from the tuning microphone. Generating the corrected control signal based on the control signal from the servo controller and the detected position of the flange relative to the center section comprises generating the corrected control signal further based on the configurable filtering parameter. In some such aspects, the method further comprises monitoring noise control performance over time based on the further feedback to determine which of the different values of the configurable filtering parameter most reduces a-weighted Root Mean Square (RMS) sound pressure.

In some aspects, the method further comprises enabling or disabling feedforward control to produce the antinoise based respectively on whether the detected position of the flange is away from the longitudinal axis of the center section by more or less than a threshold amount.

The features, functions and advantages that have been discussed can be achieved independently in various aspects or may be combined in yet other aspects, further details of which can be seen with reference to the following description and the drawings.

BRIEF DESCRIPTION OF THE DRAWINGS

Figure 1:
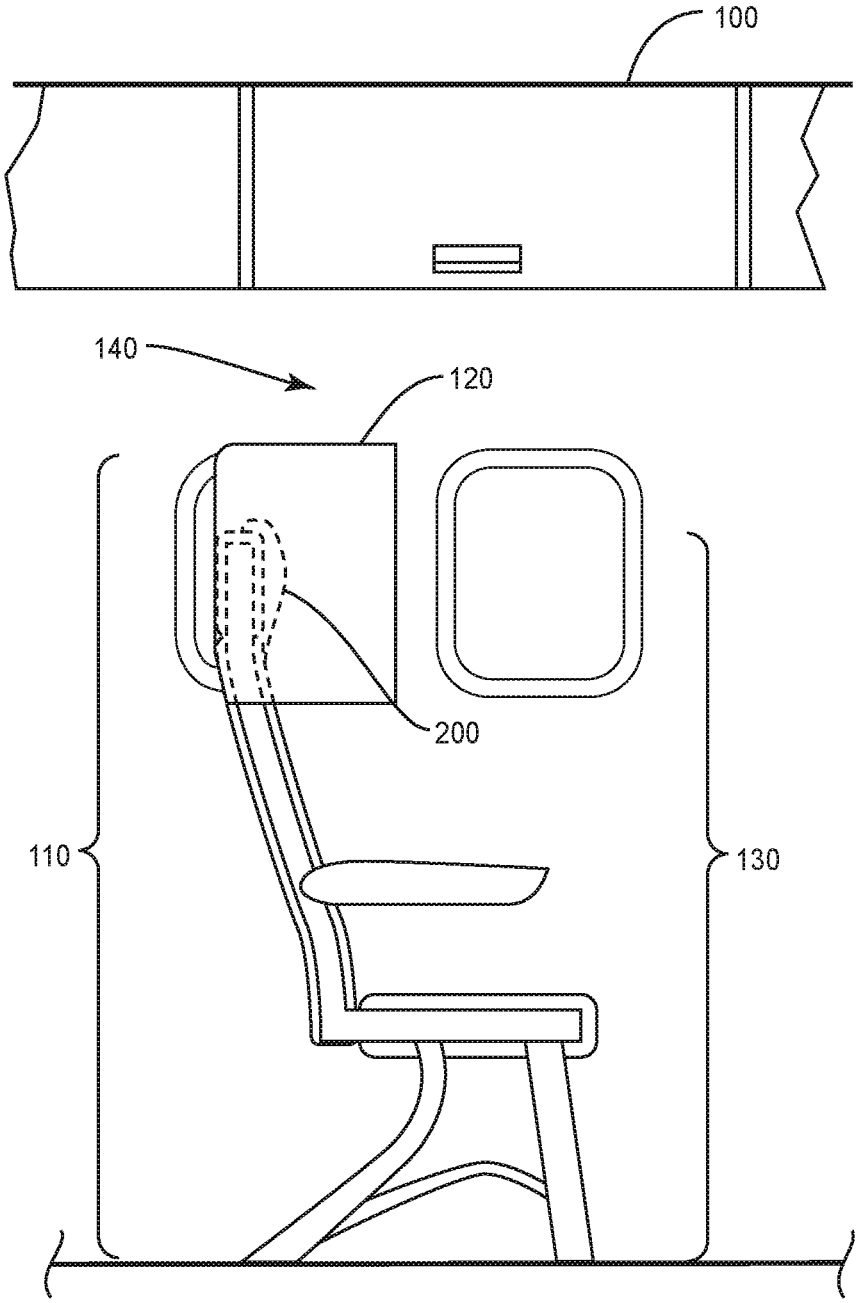

Having thus described variations of the disclosure in general terms, reference will now be made to the accompanying drawings, which are not necessarily drawn to scale. Indeed, aspects of the present disclosure are illustrated by way of example and are not limited by the accompanying figures with like references indicating like elements. In general, the use of a reference numeral should be regarded as referring to the depicted subject matter according to one or more aspects, whereas discussion of a specific instance of an illustrated element will append a letter designation thereto (e.g., discussion of a speaker 210, generally, as opposed to discussion of particular instances of speakers 210*a*, 210*b*).

FIG. 1 is a side-view schematic illustrating a portion of an example vehicle interior, according to aspects of the present disclosure.

Figure 2:
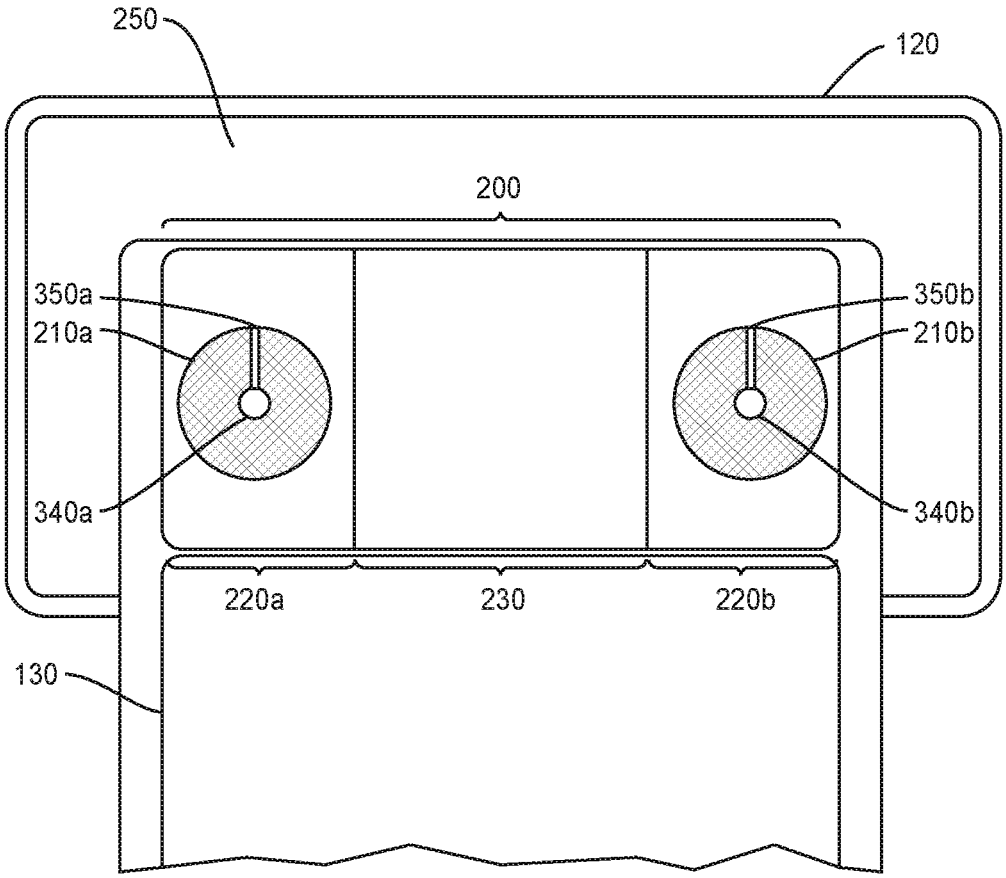

FIG. 2 is a front-view schematic illustrating an example seat assembly, according to aspects of the present disclosure.

Figure 3:
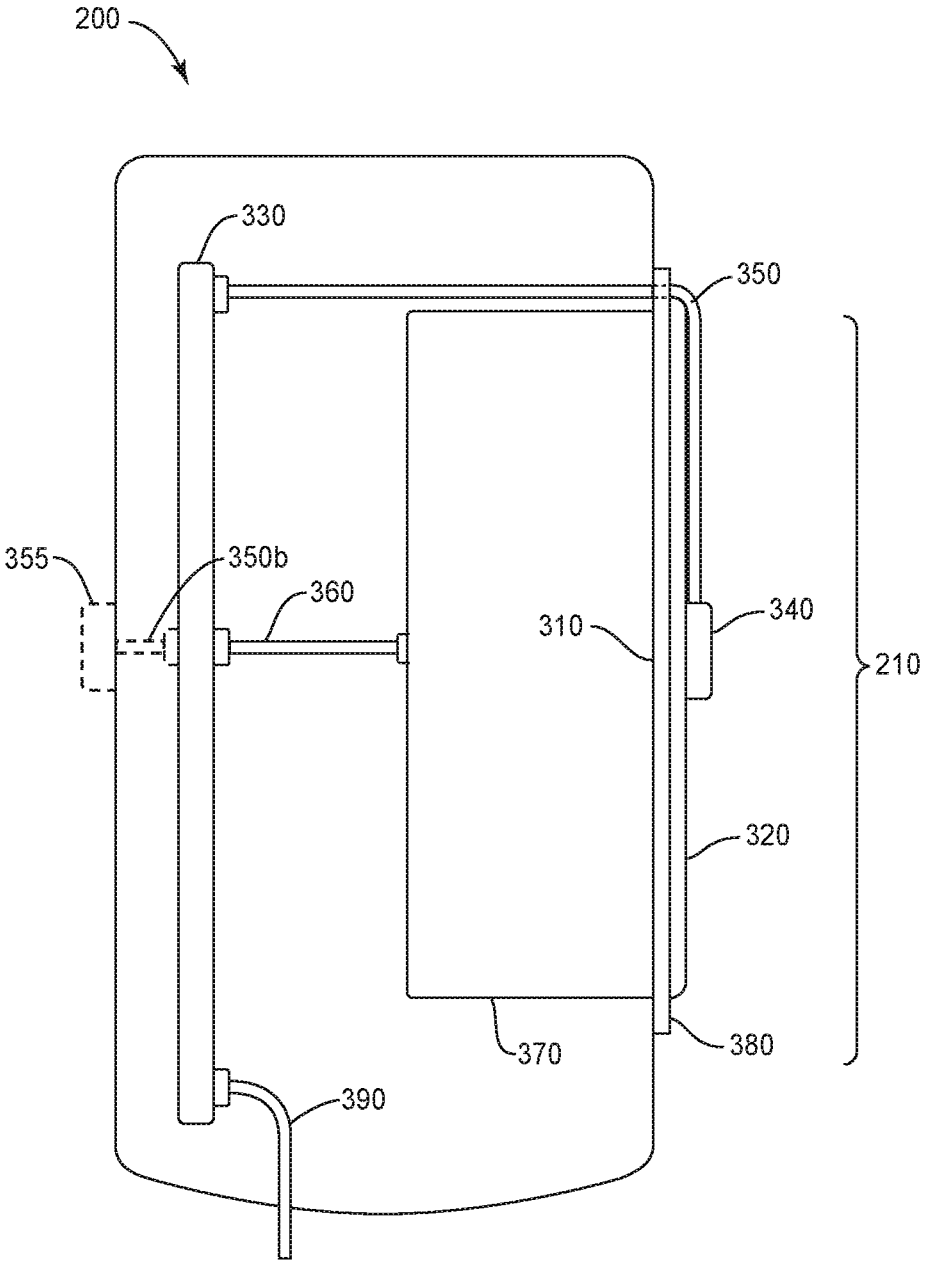

FIG. 3 is a side-view schematic illustrating an example headrest, according to aspects of the present disclosure.

Figure 4A:
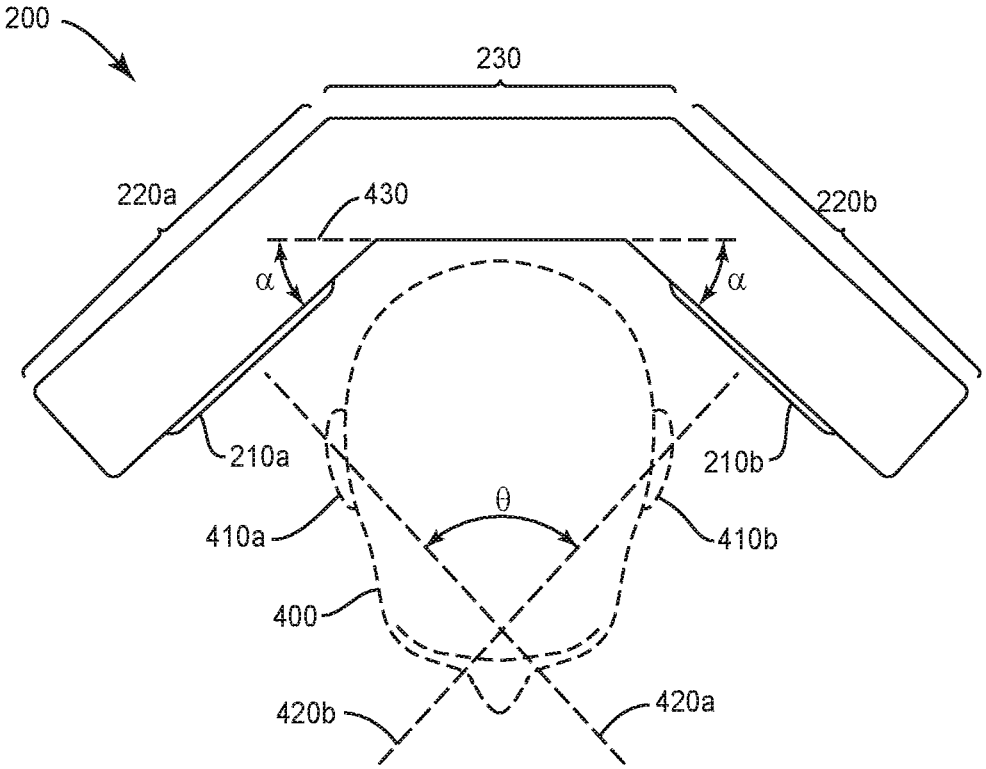

FIG. 4A is a top-view schematic illustrating an example headrest, according to aspects of the present disclosure.

Figure 4B:
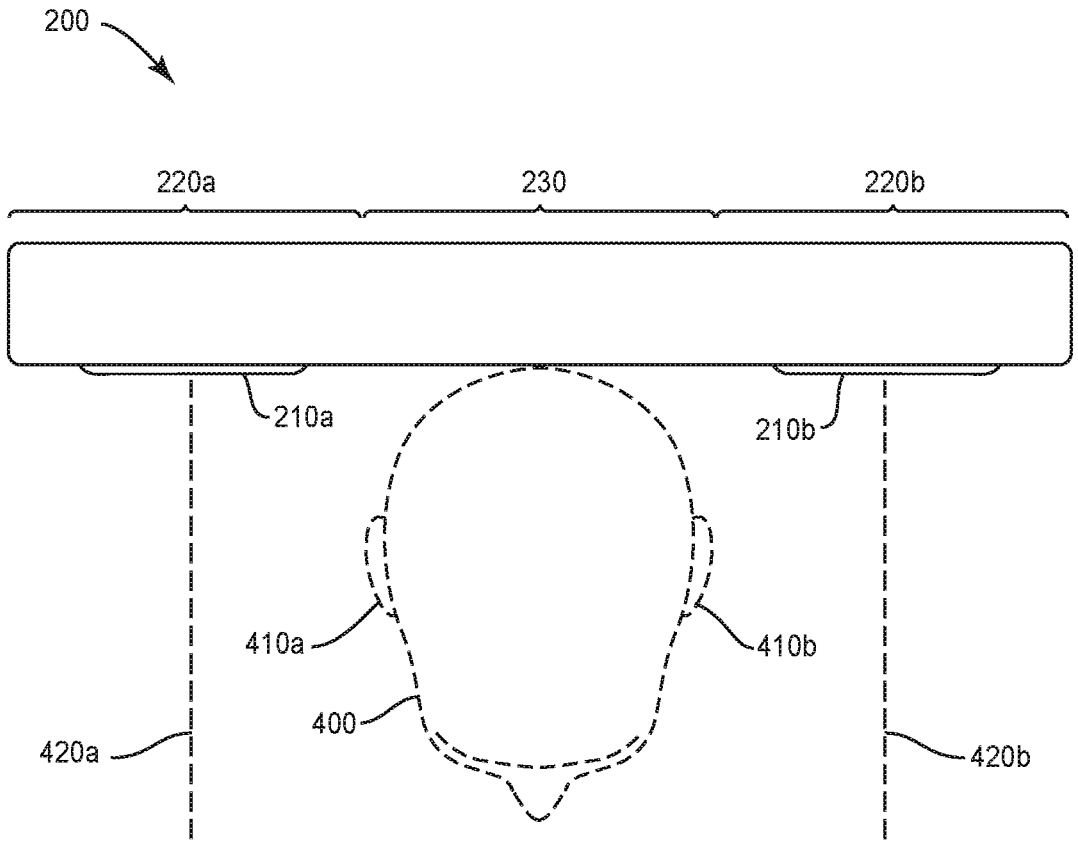

FIG. 4B is a top-view schematic illustrating an example headrest, according to aspects of the present disclosure.

Figure 4C:
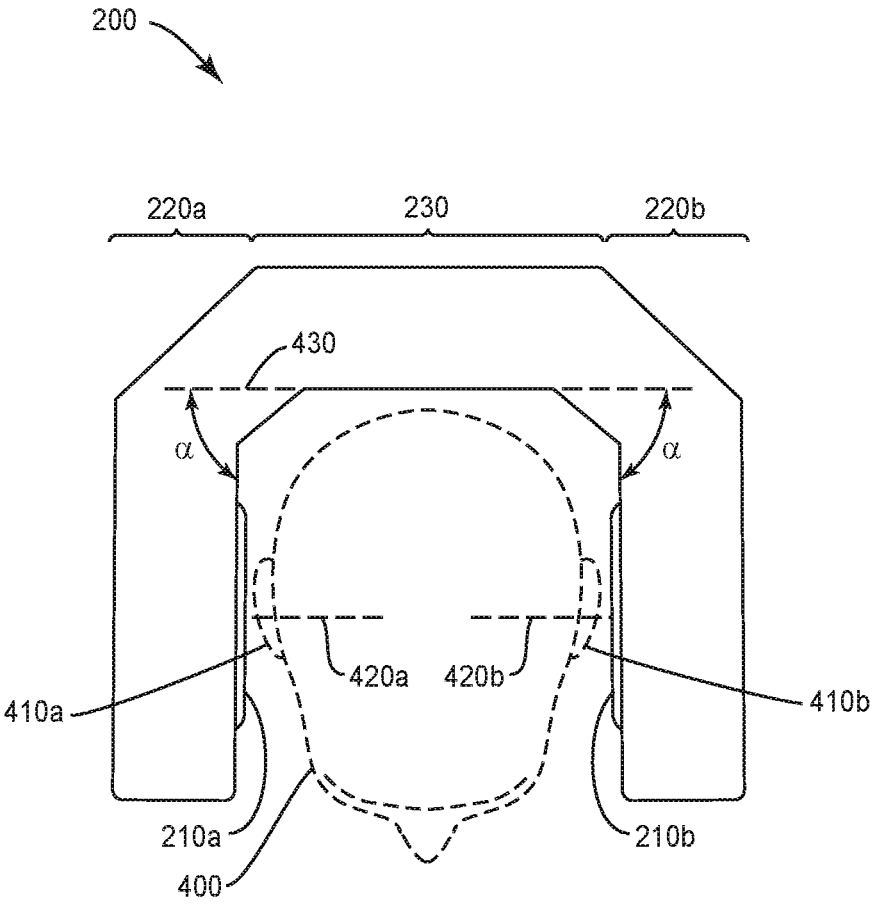

FIG. 4C is a top-view schematic illustrating an example headrest, according to aspects of the present disclosure.

Figure 4D:
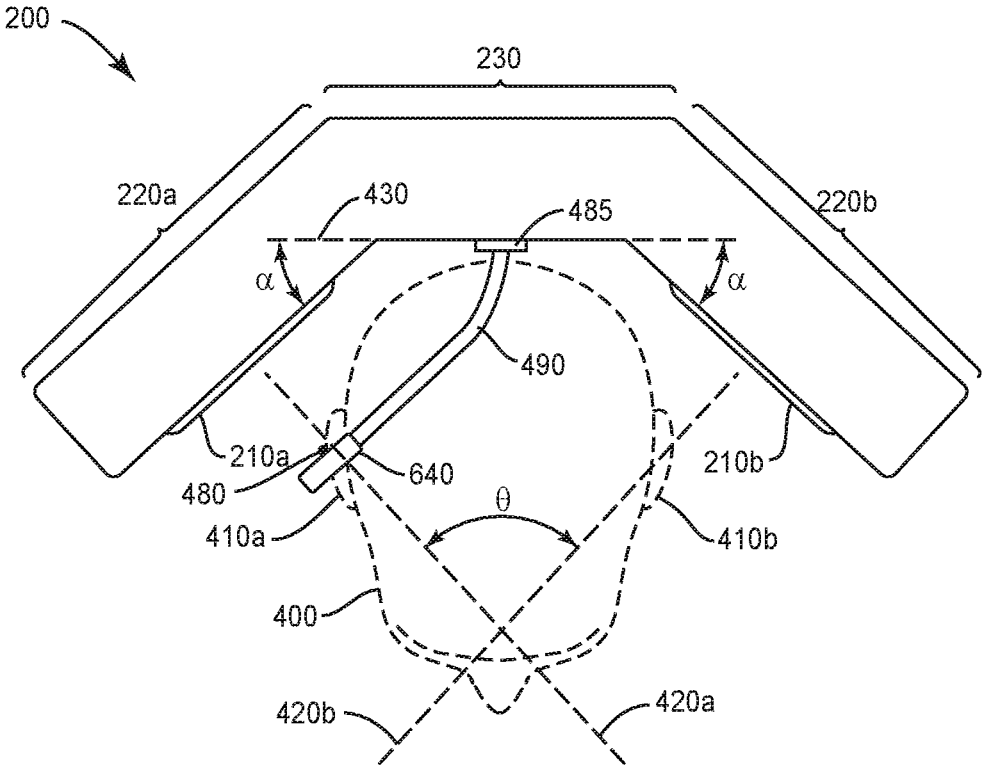

FIG. 4D is a top-view schematic illustrating an example headrest to which a tuning microphone is mounted via a flexible boom, according to aspects of the present disclosure.

Figure 4E:
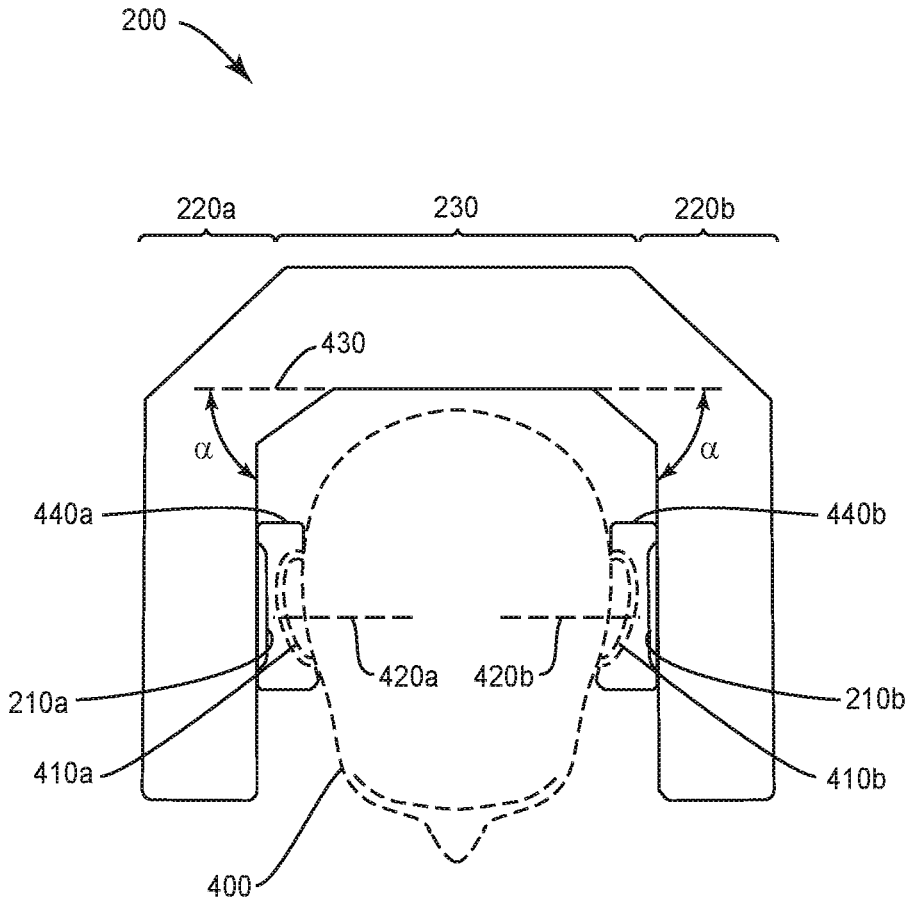

FIG. 4E is a top-view schematic illustrating an example headrest in an over-the-ear arrangement, according to aspects of the present disclosure.

Figure 5:
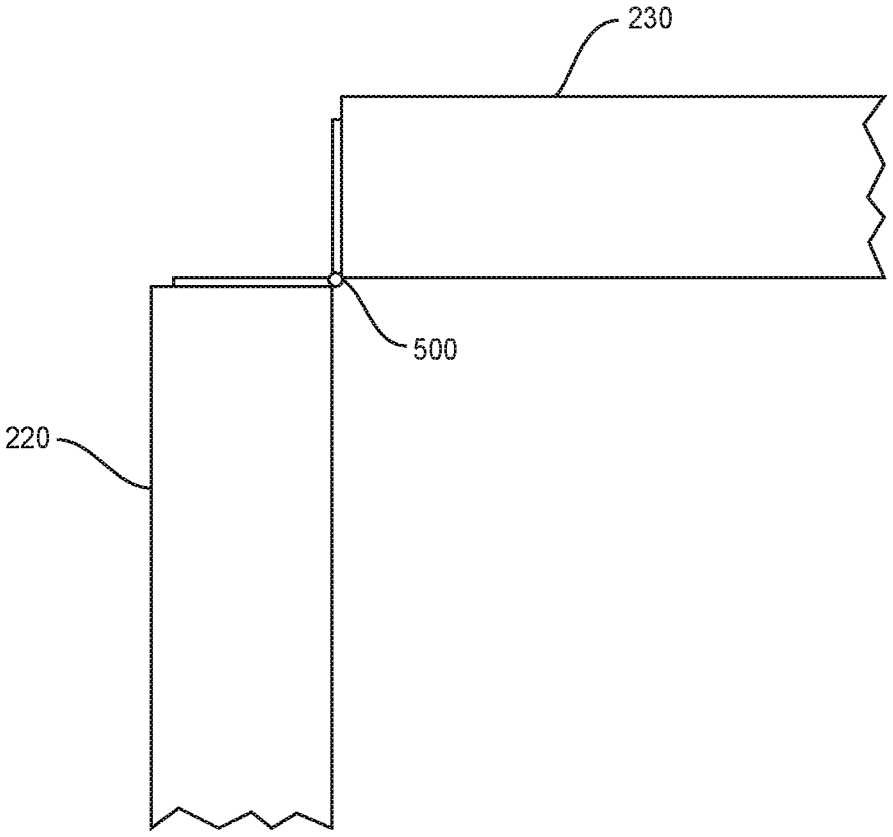

FIG. 5 is a top-view schematic illustrating an example headrest comprising a hinge, according to aspects of the present disclosure.

Figure 6:
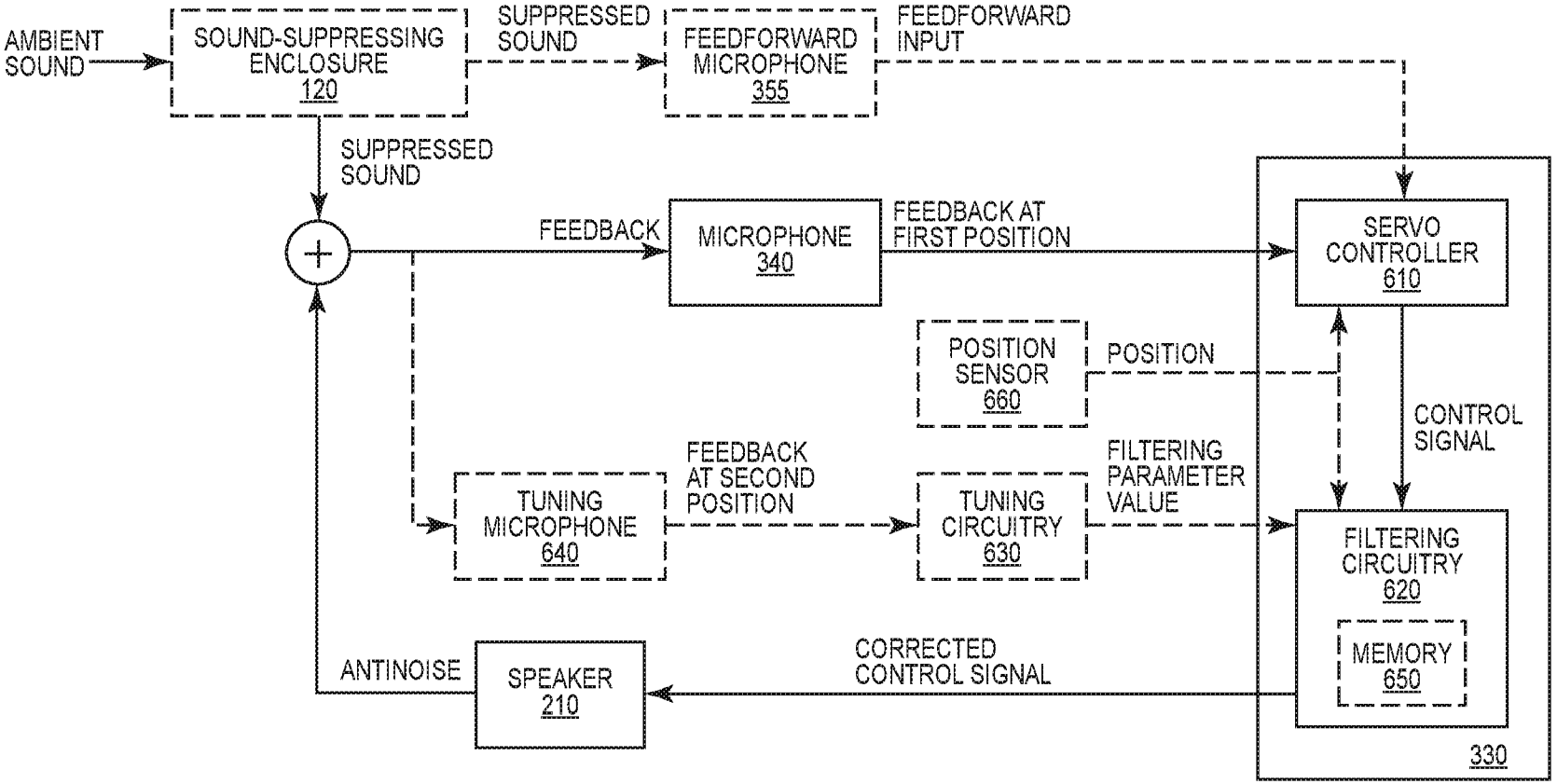

FIG. 6 is a block diagram illustrating an example ANC system, according to aspects of the present disclosure.

Figure 7:
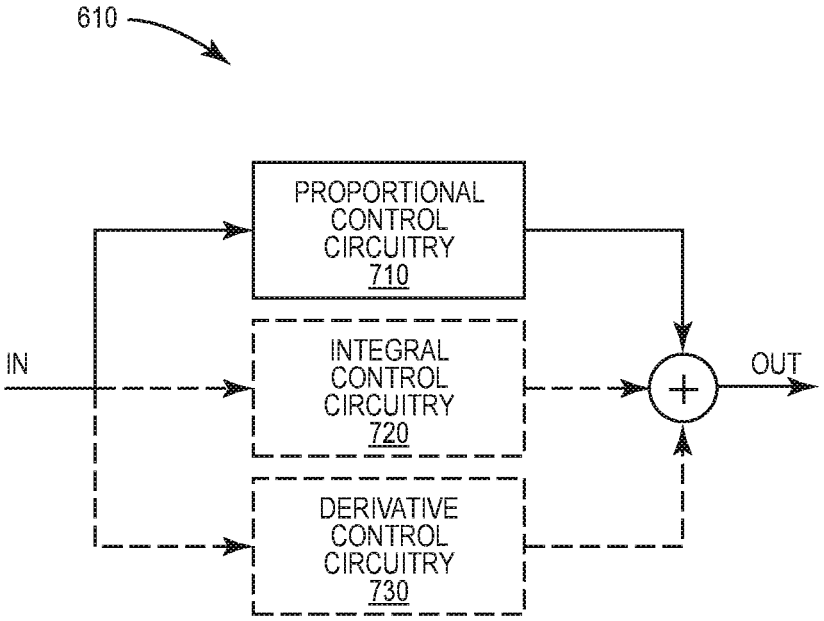

FIG. 7 is a block diagram illustrating an example servo controller, according to aspects of the present disclosure.

FIGS. 8-11 are flow diagrams illustrating an example methods, according to aspects of the present disclosure.

DETAILED DESCRIPTION

Aspects of the present disclosure are generally directed to active noise control (ANC). Particular aspects are suitable for use in vehicles, such as aircraft, spacecraft, rotorcraft, satellites, rockets, terrestrial vehicles, water-borne surface vehicles, water-borne sub-surface vehicles, subterranean vehicles, or any combination thereof. Particular aspects are suitable for commercial, transport, and/or industrial purposes. Different vehicles often present different noise control challenges.

Indeed, techniques that may be effective for noise control in one type of vehicle may be unsuitable for noise control in another type of vehicle. Consider, for example, noise control in a turboprop aircraft as compared to a jet aircraft. In a turboprop aircraft, the majority of the interior sound field is typically related to the propellers, such that noise at one location in the cabin has a coherent relationship to the noise at other locations in the cabin, even at relatively large distances. In such a vehicle, a cancelling field can be effectively produced at one location based on sound input received at a relatively distant location. As long as the complexity of the sound field can be reproduced (which increases with increasing frequency), good noise cancellation can be achieved. Also, since the noise is generally periodic and changes over a relatively slow time scale, adaptation of the control law to cancel the sound is generally not computationally intensive.

In contrast, on a jet aircraft, a significant (if not a majority) of the noise is caused by turbulent flow of air over aircraft surfaces. The typical resulting sound field does not display good coherence (even over small distances) and also changes rapidly over time. Thus, noise sampled from a relatively distant location is often inadequate for producing an effective noise cancelling field elsewhere. This is just one example in which the same approach that works on one vehicle may not be as effective (or may be ineffective) in another vehicle.

There are numerous similar challenges and difficulties in implementing effective noise control solutions in different environments. Various aspects of the present disclosure are suitable for a variety of such environments. At least some of the aspects discussed herein are particularly useful for noise control in vehicles of various types, though other aspects may be useful in other environments in which noise control may be desired. FIG. 1 illustrates an example of an environment in which aspects of the present disclosure may be advantageous. FIG. 1 is a schematic side-view of a portion of an aircraft 100 with a cut-away revealing the interior of a passenger cabin 140. Positioned within the passenger cabin 140 is a seat assembly 110. The seat assembly 110 comprises a seat 130, a headrest 200, and a sound-suppressing enclosure 120.

The sound-suppressing enclosure 120 is disposed within, and spaced from, the interior walls of the aircraft 100. As shown in more detail in the schematic of FIG. 2, the sound-suppressing enclosure 120 has an interior cavity 250 and (as will be explained further below) is configured to produce suppressed sound by suppressing frequencies of ambient sound that enter the interior cavity 250. In some aspects, the sound-suppressing enclosure 120 has a geometry and/or comprises materials such that the suppressed frequencies are above a threshold frequency. The headrest 200 is disposed within the interior cavity 250 of the sound-suppressing enclosure 120, and is mounted to the seat 130.

The headrest 200 comprises a center section 230, which may (in some aspects) be padded and/or molded to comfortably accommodate the head of a passenger (not shown in FIG. 2). One or more speakers 210 are mounted to the headrest 200. In the particular example of FIG. 2, the headrest 200 comprises flanges 220*a*, 220*b* extending away from the center section 230 on opposing lateral sides of the center section 230, and a speaker 210*a*, 210*b* is mounted to each of the flanges 220*a*, 220*b*, respectively. The speakers 210*a*, 210*b* are configured to produce antinoise that destructively interferes with frequencies of the suppressed sound. In some aspects, the speakers 210*a*, 210*b* are configured to produce the antinoise such that the frequencies that are destructively interfered with are below the aforementioned threshold frequency.

In some aspects, the sound-suppressing enclosure 120 and the antinoise output from the speakers 210*a*, 210*b* in the headrest 200 work jointly to actively control noise across a broad band of frequencies. For example, in some aspects, the sound-suppressing enclosure 120 is configured to suppress frequencies of ambient sound above the threshold frequency, but as a practical consequence of its design, may (in some aspects) amplify sound frequencies below the threshold frequency. This amplification induced by the sound-suppressing enclosure may, for example, be due to resonance within the interior cavity 250. In some such aspects, the antinoise output from the speakers 210*a*, 210*b* in the headrest 200 is configured to counteract the amplification caused by the sound-suppressing enclosure 120 by destructively interfering with frequencies of the suppressed sound below the threshold frequency. In particular, to destructively interfere with the frequencies below the threshold frequency, the antinoise may be configured to, at a given listening position (e.g., the ear of a listener), destructively interfere by amounts respectively greater than any respective amplification of the frequencies below the threshold frequency induced by the sound-suppressing enclosure 120.

Additionally or alternatively, in some aspects, the antinoise output from the speakers 210*a*, 210*b* is configured to destructively interfere with frequencies below the threshold frequency, but as a practical consequence of its design, may (in some aspects) amplify sound frequencies above the threshold frequency. This amplification induced by the antinoise may, for example, be due to dynamic ambient sound conditions that cause the antinoise to misalign such that some constructive interference occurs. In some such aspects, the sound-suppressing enclosure 120 is configured to counteract the amplification caused by the antinoise output from the speakers 210*a*, 210*b*. In particular, to suppress the frequencies above the threshold frequency, the sound-suppressing enclosure 120 may be configured to, at a given listening position (e.g., the ear of a listener) suppress the frequencies above the threshold frequency by amounts respectively greater than any respective constructive interference of the frequencies above the threshold frequency induced by the antinoise.

Thus, in view of the above, the antinoise and/or sound-suppressing enclosure 120 may jointly contribute to the efficacy of the overall ANC system, e.g., in a complimentary fashion. In some particular aspects, the suppressing (provided by the sound-suppressing enclosure 120) and the destructive interference (provided by the antinoise) jointly provide a peak power reduction of sound energy at a frequency below 200 Hz.

In particular aspects, practical considerations may limit the magnitude on overall sound pressure provided by the sound-suppressing enclosure 120 on a jet aircraft. For example, it may be impractical to seal the sound-suppressing enclosure 120 or otherwise limit a passenger of the aircraft 100 from freely getting in and out of their seat 130. Notwithstanding, the sound-suppressing enclosure 120 may, in some aspects, alter the power spectrum of the ambient noise such that the predominant sound frequency (i.e., the frequency having the most sound energy) is lowered. This may be accomplished with a sound-suppressing enclosure 120 as illustrated schematically in FIG. 2, for example, while still allowing easy ingress and egress (e.g., by having a partially- or fully-open side to the sound-suppressing enclosure 120).

A shift of peak amplitude in the sound power spectrum from high frequencies to low frequencies caused by the sound-suppressing enclosure 120 may provide significant benefit to the overall reduction in sound power, even in aspects in which the overall sound pressure is the same with and without the sound-suppressing enclosure 120. For example, the sound-suppressing enclosure may synergize with the noise controlling effect of antinoise that is more effective at reducing sound at low frequencies, and less effective at high frequencies.

One or more microphones 340 are also disposed within the interior cavity 250 of the sound-suppressing enclosure 120. In the example of FIG. 2, microphones 340*a*, 340*b* are mounted to the front grills of the speakers 210*a*, 210*b*, respectively. The microphones 340*a*, 340*b* are configured to receive feedback comprising a combination of the suppressed sound produced by the sound-suppressing enclosure 120 and the antinoise produced by the speakers 210*a*, 210*b*. Each microphone 340*a*, 340*b* is connected via a respective input line 350*a*, 350*b* to processing circuitry 330, as shown in FIG. 3.

FIG. 3 is schematic of the headrest 200 as viewed from the side, cutaway to reveal example details of the interior of the headrest 200. In this particular example, processing circuitry 330 is disposed within the headrest 200, and is communicatively coupled to the speaker 210 via an output line 360. The processing circuitry 330 is also communicatively coupled to the microphone 340 via an input line 350*a*. The processing circuitry 330 is also connected to a power source (not shown), such as a battery or electrical outlet via power line 390. The processing circuitry 330 is configured to control the speaker 210 to produce the antinoise based on the feedback received by the microphone 340.

The speaker 210, which is mounted to the headrest 200, comprises (among other things) a front grill 320, a mounting bracket 380, a housing 370, and a diaphragm 310. The front grill 320 is disposed over the diaphragm 310 and is mounted to the mounting bracket 380 which mates with the headrest 200 (e.g., using retention clips or screws, not shown). The diaphragm 310 in this example is substantially flat and disposed within the housing 370. The housing 370 is connected to (and retained within the headrest 200 by) the mounting bracket 380.

Although the diaphragm 310 in this example is substantially flat, other aspects of the present disclosure include a diaphragm 310 having any suitable geometry to produce the antinoise (e.g., cone-shaped). In some aspects, a substantially flat diaphragm 310 advantageously provides a smaller distance between the diaphragm 310 and the microphone 340 mounted to the front grill 320 as compared to geometries that use a diaphragm 310 that is concave within the housing 370. In some such aspects, this relatively smaller distance reduces the delay in the transfer function between the speaker 210 and the microphone 340, which results in a higher bandwidth error rejection and increased performance. Indeed, aspects that include small distances between the diaphragm 310, the microphone 340, and the ear of a listener may keep differences in sound energy at those respective locations small so that benefits in error rejection are similar.

In some aspects, the headrest 200 may include one or more feedforward microphones 355. For example, as shown in FIG. 3, the headrest 200 may comprise a feedforward microphone 355 that is communicatively connected to the processing circuitry 330 via an input line 350*b*. In this example, the feedforward microphone 355 is mounted to the headrest 200 at a location opposing the front grill 380. In other aspects, the feedforward microphone 355 may be positioned anywhere else on the headrest 200, e.g., perpendicular to a longitudinal axis of the headrest 200 (shown in FIGS. 4A-E and discussed below). In some aspects, the processing circuitry 330 uses microphone 340 for feedback control and feedforward microphone 355 for feedforward control. In some such aspects, the processing circuitry 330 may be configured to switch between feedback and feedforward modes by respectively switching between using microphone 340 and feedforward microphone 355 to produce a control signal used as a basis for controlling the speaker 210. In other such aspects, the processing circuitry 330 may use microphone 340*a* and microphone 340*c* to perform both feedback and feedforward control.

A speaker 210 that acts as a uniform source is generally preferable over a speaker that produces significant diffraction, or in which diffraction occurs at frequencies in which noise control is less effective. In some aspects, the speaker 210 is of a relatively small diameter (e.g., 2.5 inches), which may serve to reduce diffraction that undermines the efficacy of the emitted antinoise. Although a single, larger speaker (e.g., 8 inches in diameter) mounted to the center section 230 may, in some aspects, serve a similar purpose in reducing diffraction (as compared to smaller speakers 210*a*, 210*b* mounted to the flanges 220*a*, 220*b*, respectively), the diffraction caused by a relatively larger speaker 210 may occur at a lower frequency where noise control is generally less effective. If diffraction occurs at a given frequency, variation of phase and/or amplitude in the sound field may spatially decrease the desirable effects of ANC.

FIGS. 4A, 4B, 4C, 4D, and 4E are top-down schematic views of the headrest 200 according to various aspects. In FIG. 4A, the flanges 220*a*, 220*b* are canted inward (e.g., towards the head 400 of a listener, if present), such that projection axes 420*a*, 420*b* extending in the direction in which the antinoise is projected from the center of each of the speakers 210*a*, 210*b*, respectively, intersect at an angle θ. In this example, the angle θ of intersection between the projection axes 420*a*, 420*b* is 50 degrees, as each flange 220*a*, 220*b* is canted at an angle α of 25 degrees relative to a longitudinal axis 430 of the center section 230. In this particular example, the proportions of the headrest 200, mounting positions of the speakers 210*a*, 210*b*, and angle α of the flanges 220*a*, 220*b* relative to the longitudinal axis 430 of the center section 230 are such that the projection axes 420*a*, 420*b* advantageously pass through the ears 410*a*, 410*b* of the listener.

In some aspects, placement of speakers 210*a*, 210*b* in the headrest 200 at angle α toward the ears 410*a*, 410*b* of the listener as shown in FIG. 4A reduces the latency between the speakers 210*a*, 210*b* and the listener as compared to the headrest 200 illustrated in FIG. 4B, while also reducing the passive amplification impact of the speakers 210*a*, 210*b*, as compared to placement at an angle of 90 degrees as shown in FIG. 4C. Indeed, in some aspects, the perpendicular orientation of the speakers 210*a*, 210*b* relative to the center section 230 may cause a local resonant amplification of sound frequencies in the range from 500 to 1000 Hz. Since this is a range where feedback control of sound may be less effective in some aspects, passive amplification of this kind has the potential to negatively impact overall closed-loop performance. Thus, although aspects of the present disclosure may include an arrangement as shown in FIG. 4C, particular aspects which use the smaller angle α depicted in FIG. 4A, which may result in relatively little passive amplification of the sound field (or indeed, none whatsoever, in some aspects).

Other aspects of the present disclosure include a headrest 200 in which the flanges 220*a*, 220*b* are not angled inward, as shown in FIG. 4B, such that the projection axes 420*a*, 420*b* do not intersect. While this configuration avoids some or all of the passive resonant amplification of the speakers 210*a*, 210*b* discussed above with respect to the arrangement illustrated in FIG. 4C, the speakers 210*a*, 210*b* are placed at positions further away from the ears 410*a*, 410*b* of the listener, which may introduce more error between the antinoise generated by the ANC system and the sound energy at the listener's ears 410*a*, 410*b* relative to the arrangement illustrated in, e.g., FIG. 4A.

Of course, an additional design concern for the headrest 200 is the comfort of the person whose head 400 rests in it, which is often a matter of personal taste. For example, a person may find the headrest 200 arrangement illustrated in FIG. 4C preferable to those in FIGS. 4A and 4B when trying to sleep because it may prevent the head 400 from jostling around during turbulent flight conditions. As another example, a person may find the headrest 200 arrangement illustrated in FIG. 4A or 4B preferable to that illustrated in FIG. 4C while eating due to the increased freedom of head 400 movement available.

In view of the above, the headrest 200 may, in some aspects, be flexible and/or jointed such that the headrest 200 is able to be selectively positioned in accordance with FIGS. 4A, 4B, and/or 4C. For example, as shown in the example schematic of FIG. 5, the headrest 200 may comprise one or more hinges 500 between the center section 230 and any or all of the flanges 220 to permit the flange(s) 220 to be positioned to any angle α as may be desired. Although in some aspects of the present disclosure, the speakers 230*a*, 230*b* mounted to the flanges 220*a*, 220*b* are configured to project the antinoise at respective projection axes 420*a*, 420*b* that intersect at an optimum angle that minimizes latency and avoids passive amplification at a given listening position, in some aspects, a user may be able to move the flanges 220*a*, 220*b* such that the headrest 200 is arranged in accordance with any of FIG. 4A, 4B, or 4C, as desired. This may, in some aspects, allow a user to balance physical comfort concerns with noise control efficacy according to their own preferences, for example.

In particular, the headrest 200 may be arranged as depicted in the example schematic shown in FIG. 4E. The example headrest 200 illustrated in FIG. 4E comprises cushions 440*a*, 440*b* attached to respective flanges 220*a*, 220*b*. The cushions 440*a*, 440*b* are respectively configured to enclose and/or mate with ears 420*a*, 420*b* of a listener when respective flanges 220*a*, 220*b*, are positioned away from the longitudinal axis 430 (e.g., sufficiently away from the longitudinal axis 430 depending on the size of the listener's head 400). Such an example may allow the listener to use the headrest 200 as over-the-ear or on-ear headphones when the flanges 220*a*, 220*b* are positioned as illustrated in FIG. 4E, and as stereo speakers when the flanges 220*a*, 220*b* are positioned as illustrated in FIG. 4B, for example.

In some particular aspects, the headrest 200 further comprises position sensors configured to detect the positions the flanges 220*a*, 220*b* relative to the center section 230. For example, a position sensor may be configured to detect the angle α at which flange 220*a* is positioned away from the longitudinal axis 430 of the center section 230, and another position sensor may be configured to detect the angle α at which flange 220*b* is positioned away from the longitudinal axis 430 relative to the center section 230. As will be discussed in greater detail below, the position sensors are communicatively coupled to the processing circuitry 330, and the processing circuitry 330 may control the speakers 220*a*, 220*b* to produce the antinoise based, in whole or in part, on the positions detected by the position sensors. In some aspects, the processing circuitry 330 may control the speakers 220*a*, 220*b* based on input from the position sensor(s) in addition to the above-discussed feedback received by the microphone 340.

According to one such example, the processing circuitry 330 is configured to operate according to different control configurations based on which of a plurality of positions is detected by a position sensor. For example, the processing circuitry 330 may be configured to set an attenuation level of the antinoise based on the position detected by the position sensor. In some such aspects, the processing circuitry 330 may (for example) provide more attenuation to the antinoise when a flange 220 is positioned away from the longitudinal axis 430 (e.g., FIG. 4E) as compared to when the flange 220 is positioned toward the longitudinal axis 430 (e.g., FIGS. 4A and/or 4B). Additionally or alternatively, the processing circuitry 330 may (for example) provide less gain to the antinoise when a flange 220 is positioned away from the longitudinal axis 430 (e.g., FIG. 4E) as compared to when the flange 220 is positioned toward the longitudinal axis 430 (e.g., FIGS. 4A and/or 4B).

In particular, feedforward control may be possible in some aspects (e.g., due to the simplified acoustic space when the ears 410*a*, 410*b* are in proximity to the microphones 340*a*, 340*b* and enclosed by cushions 440*a*, 440*b*, respectively). Accordingly, the processing circuitry 330 may, in some aspects, be configured to commence feedforward control responsive to flanges 220*a*, 220*b* being positioned away from the longitudinal axis 430 (e.g., FIG. 4E) and cease feedforward control responsive to the flanges 220*a*, 220*b* being positioned toward the longitudinal axis 430 (e.g., FIGS. 4A and/or 4B).

Additionally or alternatively, as will be explained further below, aspects of the present disclosure allow the processing circuitry 330 to be tuned through the use of a feedback loop. FIG. 4D is a top-view schematic illustrating an example headrest 200 to which a tuning microphone 640 is mounted via a boom 490. In some aspects, the boom 490 is flexible to permit the tuning microphone 640 to be positioned to a listening position 480, such as the likely location of one or the other of a typical listener's ears 410*a*, 410*b*. In some aspects, the tuning microphone 640 may be freely coupled and decoupled to the processing circuitry 330 (not shown) as needed in order to tune the ANC system (e.g., via a tuning port 485 that provides tuning input to the processing circuitry 330). According to various aspects, this tuning may provide a baseline configuration for producing the antinoise, which is adjusted based on feedback received via the microphone 340 and/or input from the position sensor(s), resulting in improved sound suppressing performance of the antinoise.

In view of the above, FIG. 6 illustrates an example ANC system 600 which, according to various aspects of the present disclosure, is useful in whole or in part with a headrest 200 in accordance with at least some of the aspects described above. The ANC system 600 comprises a microphone 340, processing circuitry 330, and a speaker 210. In general, the processing circuitry 330 is configured to control the speaker 210 to produce antinoise that destructively interferes with ambient sound to produce feedback. The microphone 340 is configured to receive the feedback (which comprises a combination of the ambient sound and antinoise), and provide that feedback to the processing circuitry 330 for further use in performing ANC. In this regard, the processing circuitry 330 may (in some aspects) be configured to control the speaker 210 to produce the antinoise without feedforward control.

According to other aspects, the processing circuitry 330 may be configured to control the speaker 210 to produce the antinoise with feedforward control. In such aspects, the ANC system 600 may comprise a feedforward microphone 355 communicatively connected to the processing circuitry 330, as discussed above. The feedforward microphone 355 is configured to receive ambient sound and provide feedforward input to the processing circuitry 330 for further use in performing ANC. In such aspects, the feedforward microphone 355 may be mounted to the headrest 200 such that the feedforward microphone 355 is insulated from detecting the antinoise. According to various aspects, the processing circuitry 330 may produce the antinoise based on the feedforward input, the feedback from the microphone 340, or both. In particular, aspects of the processing circuitry 330 may switch between using the feedforward input from the feedforward microphone 355, the feedback from the microphone 340, and/or both (e.g., based on a position detected by a position sensor 660, as discussed above).

In some aspects, the ANC system 600 further comprises the above-discussed sound-suppressing enclosure 120. In such aspects, the ambient sound enters an interior cavity 250 of the sound-suppressing enclosure 120 and is suppressed as discussed above to produce suppressed sound. In such aspects, the antinoise destructively interferes with the suppressed sound to produce feedback that is received by the microphone 340. In such aspects that also include a feedforward microphone 355, the feedforward microphone 355 receives this suppressed sound to provide the above-discussed feedforward input to the processing circuitry 330.

The microphone 340 is located at a first position (e.g., mounted to the front grill 320 of the speaker 210). The microphone 340 sends the feedback received at the first position to the processing circuitry 330. The processing circuitry 330 comprises a servo controller 610 and filtering circuitry 620, which are communicatively connected to each other. Based on the feedback received at the first position by the microphone 340, the servo controller 610 generates a control signal which the filtering circuitry 620 uses to generate a corrected control signal. In some particular aspects, the filtering circuitry 620 generates the corrected control signal based on the control signal from the servo controller 610 and one or more filtering parameters. In various aspects of the present disclosure, one, some, or all of these filtering parameters are configurable, as will be further discussed below. The filtering circuitry 620 sends the corrected control signal to the speaker 210 to produce the antinoise, which (as discussed above) combines with the ambient or suppressed sound to provide feedback to the servo controller 610 via the microphone 340. Thus, the ANC system 600 comprises a feedback loop by which effective noise control is achieved.

Some aspects of the present disclosure additionally or alternatively comprise a feedforward loop by which effective noise control is achieved. In at least some such aspects, based on the feedforward input received from the feedforward microphone 355 (e.g., in addition to, or instead of, the feedback received from the microphone 340), the servo controller 610 generates the control signal which the filtering circuitry 620 uses to generate the corrected control signal. Whether the servo controller 610 may determine which of the feedback and feedforward input to use for generating the control signal based on a position of the headrest 200, e.g., as detected by position sensor 660 communicatively coupled to the servo controller 610.

Although the control signal produced by the servo controller 610 may be effective at controlling the speaker 610 to produce antinoise without the correction performed by the filtering circuitry 620, such a servo controller 610 may be designed to provide high overall control performance which, in some aspects, may actually amplify certain frequencies (e.g., one or more frequencies above the threshold frequency). Accordingly, in some aspects, the filtering circuitry 620 tailors the control signal so that the antinoise destructively interferes with the ambient or suppressed sound such that this amplification is suppressed.

The correction introduced by the filtering circuitry 620 may, in some aspects, be tuned through the use of a tuning microphone 640 and tuning circuitry 630, which (in some aspects) may be pluggable into, and removable from, the ANC system 600 as desired. The tuning microphone 640 is placed at a second position, spaced apart from the microphone 340. In aspects that include the sound-suppressing enclosure 120, the tuning microphone 640 may also be disposed within the interior cavity 250. In particular aspects, the tuning microphone 640 may be positioned closer to where a listener's ear 410 is expected to be, e.g., by suspending the tuning microphone 640 on the end of a boom 490 mounted to the center section 230 of the headrest 200, or by other means.

The tuning microphone 640 is communicatively coupled to the tuning circuitry 630, and is configured to receive further feedback comprising a different combination of the ambient (or suppressed) sound and the antinoise (i.e., a combination as observed from the second position rather than from the first position where the microphone 340 is located). The tuning microphone 640 is further configured to provide the further feedback to the tuning circuitry 630. The tuning circuitry 630 is configured to receive the further feedback from the tuning microphone 640, and based on the further feedback, store different values of the configurable filtering parameter(s) in the filtering circuitry 620 over time.

In one particular example, while the ANC system 600 is being tuned (e.g., at a manufacturer or installer of the ANC system 600), simulated or prerecorded noise may be used as the ambient sound, and the tuning circuitry 630 may use a genetic algorithm in which values of various filtering parameters are provided to the filtering circuitry 620 over time while resultant noise control performance is monitored. Over multiple feedback loop iterations and over time, the best performing filtering parameters (e.g., the filtering parameter(s) that most reduce the a-weighted Root Mean Square (RMS) sound pressure) may be then be stored in the filtering circuitry 620 (e.g., in a memory 650) for subsequent use (e.g., during actual operation of the vehicle).

The correction introduced by the filtering circuitry 620 may additionally or alternatively be adjusted, in some aspects, based on a position of a flange 220 of the headrest 200 (e.g., relative to the center section 230 or longitudinal axis 430 of the headrest 200). According to such aspects, the position is detected by a position sensor 660, and sent to the processing circuitry 330, which is configured to control a speaker 210 to produce the antinoise based on the feedback and the detected position (e.g., by incorporating feedforward control). Thus, in some aspects, different antinoise may be produced as appropriate depending on how the flange 220 is positioned. In particular, the attenuation and/or gain of the antinoise may be adjusted based on the position of flange 220.

For example, such adjustments may be made based on a position of the flange 220 to counteract passive amplification resulting from particular configurations of the headrest 200, such as that illustrated in FIG. 4C above and/or to more aggressively suppress sound using the antinoise in other particular configurations of the headrest 200 that do not experience passive amplification to as great a degree (or at all), such as the configuration illustrated in FIG. 4B. In another example, such adjustments may be made based on a position of the flange 220 to add feedforward control in response to the acoustic space around a listener's ear 410 being simplified (e.g., by positioning the flange 220 away from the longitudinal axis 430 of the headrest as shown in FIG. 4E and discussed above) and to cease feedforward control in response to the acoustic space around the listener's ear 410 being complicated (e.g., by positioning the flange 220 towards the longitudinal axis 430 of the headrest as shown in FIG. 4A and/or FIG. 4B and discussed above).

Moreover, the headrest 200 may comprise multiple flanges 220*a*, 220*b* that are movable independently from each other. Accordingly, in some aspects, the headrest 200 comprises, for each flange 220, a respective position sensor 660 configured to detect the position (e.g., the angle) of the flange 220 relative to the center section 230. Correspondingly, the processing circuitry 330 may control the speaker 210 mounted to each flange 220 based on the feedback and the position detected by the corresponding position sensor 660.

The processing circuitry 330 may control the speaker in a variety of ways, according to various aspects of the present disclosure. For example, to set the attenuation level of the antinoise based on the position detected by the position sensor 660, the filtering circuitry 620 may be communicatively connected to the position sensor 660 and configured to decrease or increase the attenuation level of the antinoise responsive to the flange 220 being moved towards or away from the longitudinal axis 430, respectively. Thus, responsive to the flange 220 being moved away from the longitudinal axis 430 (and towards the head 400 of a listener), for example, the filtering circuitry 620 may increase the attenuation level. Correspondingly, responsive to the flange 220 being moved towards the longitudinal axis 430 (and away from the head 400 of the listener), the filtering circuitry 620 may decrease the attenuation level.

Additionally or alternatively, to set the gain level of the antinoise based on the position detected by the position sensor 660, the filtering circuitry 620 may, in some aspects, be configured to increase or decrease the gain level of the antinoise responsive to the flange 220 being moved towards or away from the longitudinal axis 430, respectively. Thus, responsive to the flange 220 being moved away from the longitudinal axis 430 (and towards the head 400 of a listener), for example, the filtering circuitry 620 may decrease the gain level. Correspondingly, responsive to the flange 220 being moved towards the longitudinal axis 430 (and away from the head 400 of the listener), the filtering circuitry 620 may increase the gain level.

To set the attenuation and/or gain level of the antinoise based on the position detected by the position sensor 660, the filtering circuitry 620 may, in some aspects, be configured to set the attenuation and/or gain level of the antinoise to one of a plurality of predefined attenuation and/or gain levels selected based on which of a plurality of predefined position ranges comprises the position detected by the position sensor 660. For example, responsive to the position sensor 660 detecting that the flange 220 is positioned at an angle $\alpha$ of less than twenty-five degrees away from the longitudinal axis 430, the filtering circuitry 620 may set the attenuation level to a predefined minimum attenuation level and/or set the gain level to a predefined maximum gain level. Responsive to the position sensor 660 detecting that the flange 220 is positioned at an angle $\alpha$ of more than eighty degrees away from the longitudinal axis 430 (for example), the filtering circuitry 620 may set the attenuation level to a predefined maximum attenuation level and/or set the gain level to a predefined minimum gain level. Further, responsive to the position sensor 660 detecting that the flange 220 is positioned at an angle $\alpha$ between twenty-five and eighty degrees away from the longitudinal axis 430 (for example), the filtering circuitry 620 may set the attenuation level and/or gain level to a level between the minimum and maximum attenuation and/or gain levels. Indeed, aspects of the present disclosure may include any number of predefined attenuation and/or gain levels and corresponding position ranges, e.g., as may be appropriate to provide accurate gain control in view of the particular design of the headrest 200 and/or environment in which the headrest 200 will be installed (e.g., in the aircraft 100).

Additionally or alternatively, responsive to the position sensor 660 detecting that the flange 220 is positioned at an angle $\alpha$ of more than a given threshold away from the longitudinal axis 430, the servo controller 610 may produce the control signal using feedforward control. Correspondingly, responsive to the position sensor 660 detecting that the flange 220 is positioned at an angle $\alpha$ of less than the given threshold away from the longitudinal axis 430, the servo controller 610 may refrain from and/or cease producing the control signal using feedforward control.

In some aspects, the servo controller 610 performs one or more proportional (P), integral (I), and/or derivative (D) control functions based on the feedback to produce a control signal that is useful for controlling the speaker 210 to produce antinoise. Thus, in some aspects, the servo controller 610 is a P controller, a PI controller, a PID controller, or a PD controller.

FIG. 7 illustrates an example servo controller 610, according to particular aspects of the present disclosure. The servo controller 610 comprises proportional control circuitry 710. In some aspects, the servo controller 610 further comprises integral control circuitry 720 and/or derivative control circuitry 730.

In particular, the servo controller 610 may be a P controller in which the proportional control circuitry 710 produces a control signal for outputting antinoise from the speaker 210 in proportion to the feedback received at the microphone 340. In other aspects, the servo controller 610 may be a PI controller that further comprises the integral control circuitry 720. In such aspects, the proportional control circuitry 710 may contribute predominantly to the control signal, and the integral control circuitry 720 may be configured to take an integral of the antinoise over time, which is combined with the output from the proportional control circuitry 710 to smooth out error or deviance between the feedback and the sound to be controlled.

Alternatively, the servo controller 610 may be a PD controller or a PID controller that comprises the derivative control circuitry 730. The derivative control circuitry 730 is configured to produce an output that shapes the output of the proportional control circuitry 710 (and intergral control circuitry 720, if present) based on a rate of change to the input to the servo controller 610. By factoring in the rate of change, the servo controller 610 attempts to predict and compensate for future errors between the antinoise and sound to be controlled. Thus, the derivative control circuitry 730 may be included in the servo controller 610 when the servo controller 610 will be used to control noise in a stable, predictable, and/or uniform sound environment (e.g., in a turboprop aircraft). Correspondingly, the derivative control circuitry 730 may be omitted from the servo controller 610 when the servo controller 610 will be used in a highly-complex and/or unpredictable sound environment (e.g., in a jet aircraft).

Figure 8:
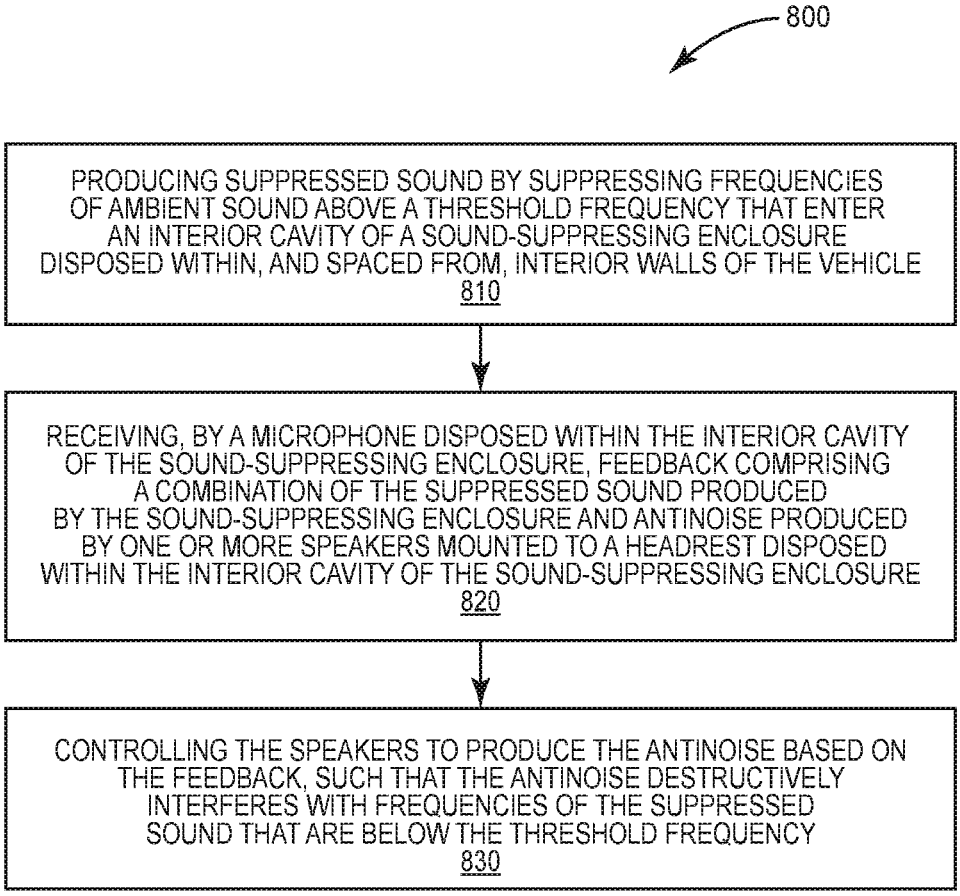

In view of all of the above, FIG. 8 illustrates an example method 800 of performing ANC within a vehicle, according to various aspects of the present disclosure. The method 800 comprises producing suppressed sound by suppressing frequencies of ambient sound above a threshold frequency that enter an interior cavity of a sound-suppressing enclosure 120 disposed within, and spaced from, interior walls of the vehicle (block 810). The method 800 further comprises receiving, by a microphone 340 disposed within the interior cavity 250 of the sound-suppressing enclosure 120, feedback comprising a combination of the suppressed sound produced by the sound-suppressing enclosure 120 and antinoise produced by one or more speakers 210 mounted to a headrest 200 disposed within the interior cavity 250 of the sound-suppressing enclosure 120 (block 820). The method 800 further comprises controlling the speakers 210 to produce the antinoise based on the feedback, such that the antinoise destructively interferes with frequencies of the suppressed sound that are above the threshold frequency (block 830).

Figure 9:
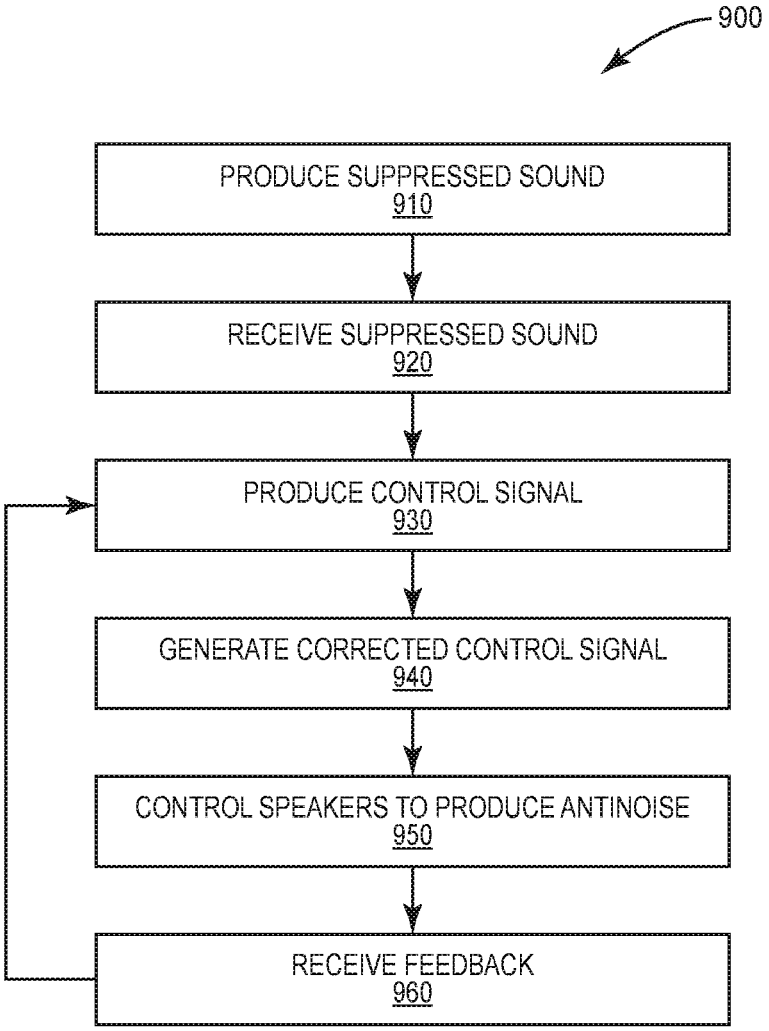

FIG. 9 illustrates a more detailed example method 900 of performing ANC within a vehicle. The method 900 comprises producing suppressed sound by suppressing frequencies of ambient sound according to aspects discussed above (e.g., using a sound-suppressing enclosure 120) (block 910). The method 900 further comprises receiving the suppressed sound using a microphone 340 (block 920) and producing a control signal (e.g., using a servo controller 610), according to aspects discussed above (block 930). The method 900 further comprises generating a corrected control signal (e.g., using filtering circuitry based on the suppressed sound) (block 940), and controlling the speakers to produce antinoise (block 950) in accordance with aspects discussed above. The method 900 further comprises receiving feedback comprising suppressed sound and the antinoise (block 960) and again producing a control signal (block 930), and so on, as discussed above.

Figure 10:
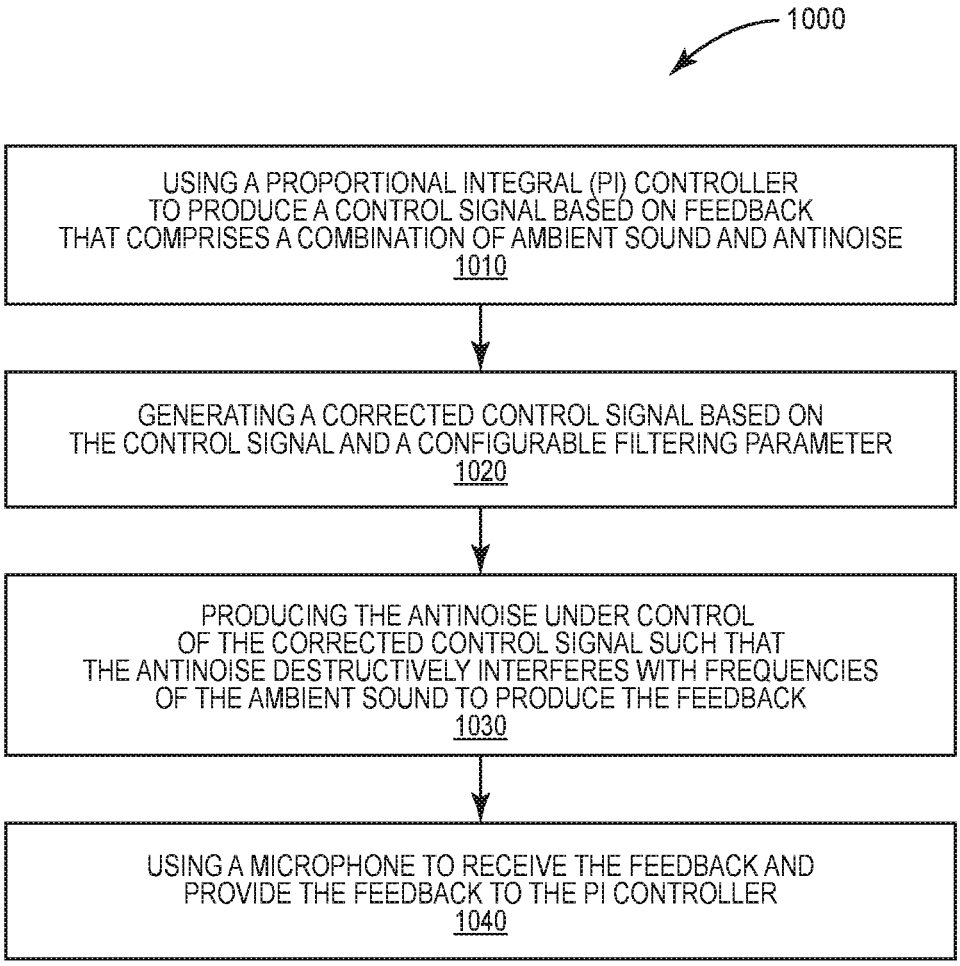

FIG. 10 illustrates another method 1000 implemented by an ANC system 600. The method 1000 comprises using a PI controller to produce a control signal based on feedback that comprises a combination of ambient sound and antinoise (block 1010). The method 1000 further comprises generating a corrected control signal based on the control signal and a configurable filtering parameter (block 1020). The method 1000 further comprises producing the antinoise under control of the corrected control signal such that the antinoise destructively interferes with frequencies of the ambient sound to produce the feedback (block 1030). The method further comprises using a microphone to receive the feedback and provide the feedback to the PI controller (block 1040).

Figure 11:
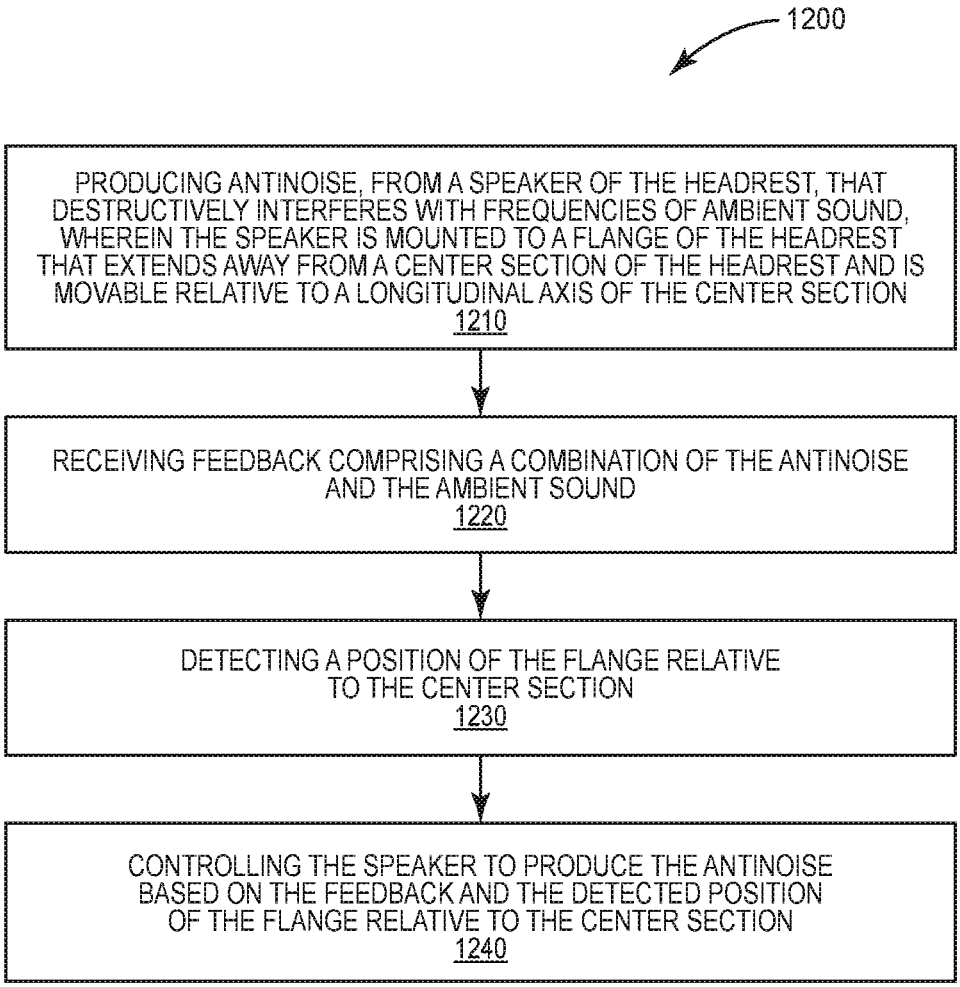

FIG. 11 illustrates yet another method 1200 implemented by an ANC headrest 200. The method 1200 comprises producing antinoise, from a speaker 210 of the headrest 200, that destructively interferes with frequencies of ambient sound (block 1210). The speaker 210 is mounted to a flange 220 of the headrest 200 that extends away from a center section 230 of the headrest 200 and is movable relative to a longitudinal axis 430 of the center section 230. The method 1200 further comprises receiving feedback comprising a combination of the antinoise and the ambient sound (block 1220), and detecting a position of the flange 220 relative to the center section 230 (block 1230). The method further comprises controlling the speaker 210 to produce the antinoise based on the feedback and the detected position of the flange 220 relative to the center section 230 (block 1240).

Figure 12:
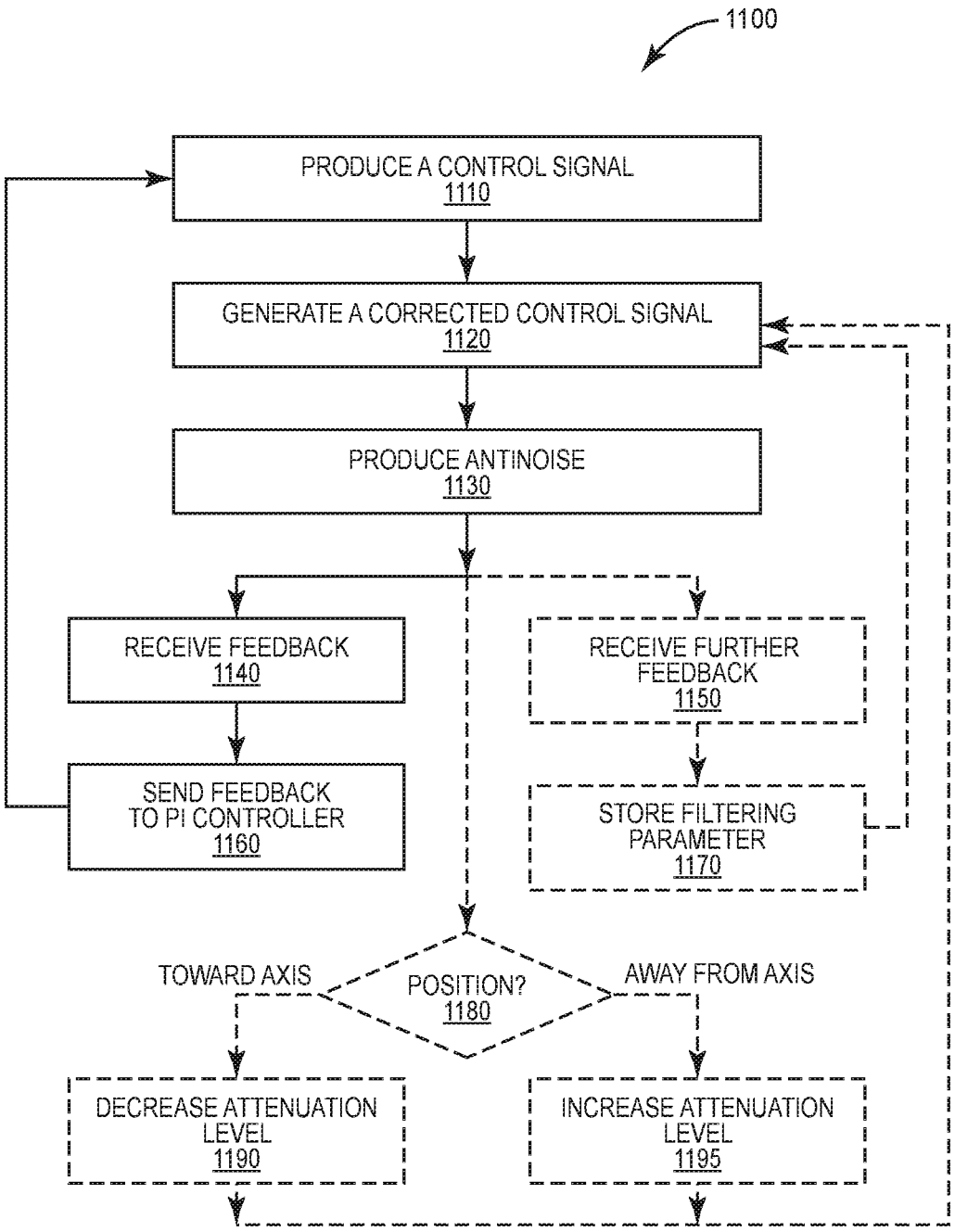

FIG. 12 illustrates a more detailed method 1100 implemented by an ANC system 600 and/or ANC headrest 200. The method 1100 comprises producing a control signal (e.g., using a servo controller 610, such as a PI controller), in accordance with aspects discussed above (block 1110). The method 1100 further comprises generating a corrected control signal (e.g., based on the control signal, a configurable filtering parameter, and/or a position of a flange 220 of the headrest 200 relative to the center section 230) in accordance with aspects discussed above (block 1120). The method 1100 further comprises producing antinoise in accordance with aspects discussed above (e.g., by controlling a speaker 210 using the corrected control signal) (block 1130). The method 1100 further comprises receiving feedback (e.g., using a microphone 340 as discussed above) (block 1140) and sending the feedback to the servo controller (block 1160) for continued production of the control signal (block 1110).

In some aspects, the method 1100 further comprises receiving further feedback (e.g., using a tuning microphone 640) (block 1150), and storing a filtering parameter (e.g., in filtering circuitry 620) for use in further generating the corrected control signal (block 1120), in accordance with aspects discussed above.

In some additional or alternative aspects, the method 1100 further comprises detecting a position of a flange 220 of the headset 200 relative to the center section 230 (block 1180), and increasing (block 1190) or decreasing (block 1195) a gain level of the antinoise responsive to the flange being moved towards or away from the longitudinal axis, respectively (e.g., by using the increased or decreased gain level in further generating the corrected control signal (block 1120)). As discussed above, the increased or decreased gain level may, in some aspects, be set to one of a plurality of predefined gain levels selected based on which of a plurality of predefined position ranges comprises the detected position.

Those skilled in the art will appreciate that the various methods and processes described herein may be implemented using various hardware configurations that generally, but not necessarily, include the use of one or more microprocessors, microcontrollers, digital signal processors, or the like, coupled to memory storing software instructions or data for carrying out the techniques described herein. In particular, those skilled in the art will appreciate that the circuits of various aspects may be configured in ways that vary in certain details from the broad descriptions given above. For instance, one or more of the processing functionalities discussed above may be implemented using dedicated hardware, rather than a microprocessor configured with program instructions. Such variations, and the engineering tradeoffs associated with each, will be readily appreciated by the skilled practitioner. Since the design and cost tradeoffs for the various hardware approaches, which may depend on system-level requirements that are outside the scope of the present disclosure, are well known to those of ordinary skill in the art, further details of specific hardware implementations are not provided herein.

Aspects of the present disclosure may additionally or alternatively include one or more aspects of the claims enumerated below, and/or any compatible combination of features described herein. The present invention may, of course, be carried out in other ways than those specifically set forth herein without departing from essential characteristics of the invention. The present aspects are to be considered in all respects as illustrative and not restrictive, and all changes coming within the meaning and equivalency range of the appended claims are intended to be embraced therein. Although steps of various processes or methods described herein may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention.

What is claimed is:

1. An active noise control (ANC) headrest comprising:

a center section comprising a longitudinal axis;

a flange extending away from the center section, wherein the flange is moveable relative to the longitudinal axis of the center section;

a position sensor configured to detect a position of the flange relative to the center section;

a speaker mounted to the flange, wherein the speaker is configured to produce antinoise that destructively interferes with frequencies of ambient sound;

a microphone configured to receive feedback comprising a combination of the antinoise and the ambient sound;

processing circuitry communicatively coupled to the speaker, the microphone, and the position sensor, wherein the processing circuitry is configured to control the speaker to produce the antinoise based on the feedback and the position detected by the position sensor, wherein the processing circuitry comprises:

a servo controller communicatively coupled to the microphone, wherein the servo controller is configured to produce a control signal based on the feedback;

filtering circuitry communicatively coupled to the servo controller, the position sensor, and the speaker, wherein the filtering circuitry is configured to generate a corrected control signal based on the control signal from the servo controller and the position detected by the position sensor:

wherein to control the speaker to produce the antinoise, the processing circuitry is configured to use the corrected control signal to control the speaker.

2. The headrest of claim 1 , wherein to generate the corrected control signal based on the control signal from the servo controller and the position detected by the position sensor, the filtering circuitry is configured to set an attenuation level of the antinoise based on the position detected by the position sensor.

3. The headrest of claim 2, wherein to set the attenuation level of the antinoise based on the position detected by the position sensor, the filtering circuitry is configured to set the attenuation level of the antinoise to one of a plurality of predefined attenuation levels selected based on which of a plurality of predefined position ranges comprises the position detected by the position sensor.

4. The headrest of claim 2, wherein to set the attenuation level of the antinoise based on the position detected by the position sensor, the filtering circuitry is configured to decrease or increase the attenuation level of the antinoise responsive to the flange being moved towards or away from the longitudinal axis, respectively.

5. The headrest of claim 1, further comprising:

a tuning microphone spaced apart from the microphone, wherein the tuning microphone is configured to receive further feedback comprising a different combination of the ambient sound and the antinoise;

tuning circuitry communicatively coupled to the tuning microphone and the filtering circuitry, wherein the tuning circuitry is configured to store different values of a configurable filtering parameter in the filtering circuitry over time based on the further feedback from the tuning microphone;

wherein to generate the corrected control signal based on the control signal from the servo controller and the position detected by the position sensor, the filtering circuitry is configured to generate the corrected control signal further based on the configurable filtering parameter.

6. The headrest of claim 5, wherein the tuning circuitry is further configured to monitor noise control performance over time based on the further feedback to determine which of the different values of the configurable filtering parameter most reduces a-weighted Root Mean Square (RMS) sound pressure.

7. The headrest of claim 1, wherein, relative to the antinoise produced by the corrected control signal, the control signal is configured to produce different antinoise having a greater overall a-weighted RMS sound pressure reduction and a peak amplitude at a higher frequency.

8. The headrest of claim 1, further comprising a feedforward microphone configured to provide feedforward input to the processing circuitry, wherein the processing circuitry is further configured to enable or disable feedforward control using the feedforward input based respectively on whether the position of the flange detected by the position sensor is away from the longitudinal axis of the center section by more or less than a threshold amount.

9. An aircraft comprising:

a passenger cabin;

a seat disposed within the passenger cabin;

a headrest mounted to the seat, wherein the headrest comprises:

a center section comprising a longitudinal axis;

a flange extending away from the center section, wherein the flange is moveable relative to the longitudinal axis of the center section;

a position sensor configured to detect a position of the flange relative to the center section;

a speaker mounted to the flange, wherein the speaker is configured to produce antinoise that destructively interferes with frequencies of ambient sound;

a microphone configured to receive feedback comprising a combination of the antinoise and the ambient sound; and processing circuitry communicatively coupled to the speaker, the microphone, and the position sensor, wherein the processing circuitry is configured to control the speaker to produce the antinoise based on the feedback and the position detected by the position sensor, wherein the processing circuitry comprises:

a servo controller communicatively coupled to the microphone, wherein the servo controller is configured to produce a control signal based on the feedback;

filtering circuitry communicatively coupled to the servo controller, the position sensor, and the speaker, wherein the filtering circuitry is configured to generate a corrected control signal based on the control signal from the servo controller and the position detected by the position sensor;

wherein to control the speaker to produce the antinoise, the processing circuitry is configured to use the corrected control signal to control the speaker.

10. The aircraft of claim 9, wherein to generate the corrected control signal based on the control signal from the servo controller and the position detected by the position sensor, the filtering circuitry is configured to set an attenuation level of the antinoise based on the position detected by the position sensor.

11. The aircraft of claim 10, wherein to set the attenuation level of the antinoise based on the position detected by the position sensor, the filtering circuitry is configured to set the attenuation level of the antinoise to one of a plurality of predefined attenuation levels selected based on which of a plurality of predefined position ranges comprises the position detected by the position sensor.

12. The aircraft of claim 10, wherein to set the attenuation level of the antinoise based on the position detected by the position sensor, the filtering circuitry is configured to decrease or increase the attenuation level of the antinoise responsive to the flange being moved towards or away from the longitudinal axis, respectively.

13. The aircraft of claim 9, further comprising:

a tuning microphone spaced apart from the microphone, wherein the tuning microphone is configured to receive further feedback comprising a different combination of the ambient sound and the antinoise;

tuning circuitry communicatively coupled to the tuning microphone and the filtering circuitry, wherein the tuning circuitry is configured to store different values of a configurable filtering parameter in the filtering circuitry over time based on the further feedback from the tuning microphone;

wherein to generate the corrected control signal based on the control signal from the servo controller and the position detected by the position sensor, the filtering circuitry is configured to generate the corrected control signal further based on the configurable filtering parameter.

14. The aircraft of claim 13, wherein the tuning circuitry is further configured to monitor noise control performance over time based on the further feedback to determine which of the different values of the configurable filtering parameter most reduces a-weighted Root Mean Square (RMS) sound pressure.

15. The aircraft of claim 9, wherein, relative to the antinoise produced by the corrected control signal, the control signal is configured to produce different antinoise having a greater overall a-weighted RMS sound pressure reduction and a peak amplitude at a higher frequency.

16. The aircraft of claim 9, further comprising a feedforward microphone configured to provide feedforward input to the processing circuitry, wherein the processing circuitry is further configured to enable or disable feedforward control using the feedforward input based respectively on whether the position of the flange detected by the position sensor is away from the longitudinal axis of the center section by more or less than a threshold amount.

17. A method, implemented by an active noise control (ANC) headrest, the method comprising:

producing antinoise from a speaker of the headrest, wherein the antinoise destructively interferes with frequencies of ambient sound and the speaker is mounted to a flange of the headrest that extends away from a center section of the headrest and is movable relative to a longitudinal axis of the center section;

receiving feedback comprising a combination of the antinoise and the ambient sound;

detecting a position of the flange relative to the center section;

controlling the speaker to produce the antinoise based on the feedback and the detected position of the flange relative to the center section; and enabling or disabling feedforward control to produce the antinoise based respectively on whether the detected position of the flange is away from the longitudinal axis of the center section by more or less than a threshold amount.

18. The method of claim 17, further comprising:

using a servo controller to produce a control signal based on the feedback;

generating a corrected control signal based on the control signal from the servo controller and the detected position of the flange relative to the center section;

wherein controlling the speaker to produce the antinoise comprises using the corrected control signal to control the speaker.

19. The method of claim 18, wherein generating the corrected control signal based on the control signal from the servo controller and the detected position of the flange relative to the center section comprises setting an attenuation level of the antinoise to one of a plurality of predefined attenuation levels selected based on which of a plurality of predefined position ranges comprises the detected position.

20. The method of claim 18, wherein generating the corrected control signal based on the control signal from the servo controller and the detected position of the flange relative to the center section comprises decreasing or increasing an attenuation level of the antinoise responsive to the flange being moved towards or away from the longitudinal axis, respectively.

21. The method of claim 18, further comprising:

using a tuning microphone spaced apart from the microphone to receive further feedback comprising a different combination of the ambient sound and the antinoise;

using different values of a configurable filtering parameter to modify the control signal differently over time based on the further feedback from the tuning microphone;

wherein generating the corrected control signal based on the control signal from the servo controller and the detected position of the flange relative to the center section comprises generating the corrected control signal further based on the configurable filtering parameter.

22. The method of claim 21, further comprising monitoring noise control performance over time based on the further feedback to determine which of the different values of the configurable filtering parameter most reduces a-weighted Root Mean Square (RMS) sound pressure.

23. The headrest of claim 1, wherein the position sensor is configured to detect an angle at which the flange is positioned away from the longitudinal axis.

24. The headrest of claim 9, wherein the position sensor is configured to detect an angle at which the flange is positioned away from the longitudinal axis relative to the center section.

25. The method of claim 17, further comprising adjusting an attenuation level of the antinoise in response to moving the flange towards or away from the longitudinal axis of the center section.

* * * * *